US008854273B2

(12) United States Patent
Li et al.

(10) Patent No.: US 8,854,273 B2
(45) Date of Patent: Oct. 7, 2014

(54) ANTENNA AND COMMUNICATION DEVICE THEREOF

(75) Inventors: Wei-Yu Li, Yilan County (TW); Wei-Ji Chen, Tainan (TW)

(73) Assignee: Industrial Technology Research Institute, Hsinchu (TW)

( * ) Notice: Subject to any disclaimer, the term of this patent is extended or adjusted under 35 U.S.C. 154(b) by 201 days.

(21) Appl. No.: 13/472,451

(22) Filed: May 15, 2012

(65) Prior Publication Data

US 2013/0002501 A1 Jan. 3, 2013

Related U.S. Application Data

(60) Provisional application No. 61/502,179, filed on Jun. 28, 2011.

(30) Foreign Application Priority Data

Mar. 3, 2012 (TW) ..... 101107193 A

(51) Int. Cl.

| | |
|---|---|
| ***H01Q 9/26*** | (2006.01) |
| ***H01Q 1/24*** | (2006.01) |
| ***H01Q 5/00*** | (2006.01) |
| ***H01Q 21/28*** | (2006.01) |
| ***H01Q 11/14*** | (2006.01) |
| ***H01Q 9/42*** | (2006.01) |
| ***H01Q 1/36*** | (2006.01) |

(52) U.S. Cl.

CPC ..... *H01Q 1/243* (2013.01); *H01Q 5/0048* (2013.01); *H01Q 21/28* (2013.01); *H01Q 11/14* (2013.01); *H01Q 9/42* (2013.01); *H01Q 1/36* (2013.01)

USPC ..... 343/803; 343/741; 343/842; 343/866

(58) Field of Classification Search

CPC ..... H01Q 9/26; H01Q 9/42; H01Q 1/243; H01Q 7/00; H01Q 11/14

USPC ..... 343/803, 741, 842, 866

See application file for complete search history.

(56) References Cited

U.S. PATENT DOCUMENTS

| | | | |
|---|---|---|---|
| 4,460,899 | A | 7/1984 | Schmidt et al. |
| 5,952,983 | A | 9/1999 | Dearnley et al. |

(Continued)

FOREIGN PATENT DOCUMENTS

| | | |
|---|---|---|
| CN | 1335654 | 2/2002 |
| CN | 201117822 | 9/2008 |

(Continued)

OTHER PUBLICATIONS

Chou et al., "Internal Wideband Monopole Antenna for MIMO Access-Point Applications in the WLAN/WIMAX Bands," Microwave and Optical Technology Letters, May 2008, pp. 1146-1148, vol. 50, No. 5.

(Continued)

*Primary Examiner* — Hoang V Nguyen

(74) *Attorney, Agent, or Firm* — Jianq Chyun IP Office

(57) ABSTRACT

An antenna and a communication device thereof are provided. The antenna includes at least one ground and at least one radiating portion. The ground is disposed on a dielectric substrate, and the radiating portion includes at least one signal source and at least one closed conductor loop. The closed conductor loop has a first coupling conductor portion and a second coupling conductor portion, and the closed conductor loop has a plurality of bending portions to form a three-dimensional structure, and a first coupling gap is formed between the first and the second coupling conductor portions. The closed conductor loop further has a feeding portion and a short-circuit portion to form a second coupling gap between them. The feeding portion is electrically connected or coupled to the at least one signal source, and the short-circuit portion is electrically connected or coupled to the ground.

19 Claims, 10 Drawing Sheets

(56) References Cited

U.S. PATENT DOCUMENTS

| | | | | |
|---|---|---|---|---|
| 5,990,838 | A | 11/1999 | Burns et al. | |
| 6,104,348 | A | 8/2000 | Karlsson et al. | |
| 6,128,466 | A | 10/2000 | Terk et al. | |
| 6,154,177 | A * | 11/2000 | Saito et al. | 343/702 |
| 6,288,679 | B1 | 9/2001 | Fischer et al. | |
| 6,344,829 | B1 | 2/2002 | Lee | |
| 6,426,723 | B1 | 7/2002 | Smith et al. | |
| 6,549,170 | B1 | 4/2003 | Kuo et al. | |
| 6,583,765 | B1 | 6/2003 | Schamberger et al. | |
| 6,624,789 | B1 | 9/2003 | Kangasvieri et al. | |
| 6,624,790 | B1 | 9/2003 | Wong et al. | |
| 6,697,025 | B2 * | 2/2004 | Koyanagi et al. | 343/741 |
| 7,212,164 | B2 * | 5/2007 | Miyano et al. | 343/702 |
| 7,250,910 | B2 | 7/2007 | Yoshikawa et al. | |
| 7,271,777 | B2 | 9/2007 | Yuanzhu | |
| 7,330,156 | B2 | 2/2008 | Arkko et al. | |
| 7,342,539 | B2 * | 3/2008 | Rosenberg et al. | 343/702 |
| 7,352,328 | B2 | 4/2008 | Moon et al. | |
| 7,385,563 | B2 | 6/2008 | Bishop | |
| 7,405,699 | B2 | 7/2008 | Qin | |
| 7,460,069 | B2 | 12/2008 | Park et al. | |
| 7,498,997 | B2 | 3/2009 | Moon et al. | |
| 7,541,988 | B2 | 6/2009 | Sanelli et al. | |
| 7,561,110 | B2 | 7/2009 | Chen | |
| 7,573,433 | B2 | 8/2009 | Qin | |
| 7,586,445 | B2 | 9/2009 | Qin et al. | |
| 7,609,221 | B2 | 10/2009 | Chung et al. | |
| 7,688,273 | B2 | 3/2010 | Montgomery et al. | |
| 7,710,343 | B2 | 5/2010 | Chiu et al. | |
| 7,714,789 | B2 | 5/2010 | Tsai et al. | |
| 7,714,795 | B2 | 5/2010 | Wen et al. | |
| 7,733,285 | B2 | 6/2010 | Gainey et al. | |
| 7,768,466 | B2 * | 8/2010 | Chi et al. | 343/741 |
| 7,973,718 | B2 | 7/2011 | Mak et al. | |
| 8,259,014 | B2 * | 9/2012 | Wu | 343/702 |
| 2009/0322639 | A1 | 12/2009 | Lai | |
| 2010/0093282 | A1 | 4/2010 | Martikkala et al. | |
| 2010/0134377 | A1 | 6/2010 | Tsai et al. | |
| 2010/0156726 | A1 | 6/2010 | Montgomery et al. | |
| 2010/0156745 | A1 | 6/2010 | Andrenko et al. | |
| 2010/0156757 | A1 | 6/2010 | Naito et al. | |
| 2010/0238079 | A1 | 9/2010 | Ayatollahi et al. | |
| 2010/0295736 | A1 | 11/2010 | Su | |
| 2010/0295743 | A1 | 11/2010 | Pu et al. | |
| 2010/0295750 | A1 | 11/2010 | See et al. | |
| 2011/0019723 | A1 | 1/2011 | Lerner et al. | |
| 2011/0122027 | A1 | 5/2011 | Wong et al. | |
| 2012/0001815 | A1 | 1/2012 | Wong et al. | |

FOREIGN PATENT DOCUMENTS

| | | |
|---|---|---|
| CN | 101796688 | 8/2010 |
| CN | 201845856 | 5/2011 |
| TW | 201042826 | 12/2010 |
| TW | 201115845 | 5/2011 |

OTHER PUBLICATIONS

Saou-Wen Su, "Concurrent Dual-Band Six-Loopantenna System With Wide 3-dB Beamwidth Radiation for MIMO Access Points," Microwave and Optical Technology Letters, Jun. 2010, pp. 1253-1258, vol. 52, No. 6.

Su et al., "Low-Cost Dual-Loop-Antenna System for Dual-WLAN-Band Access Points," IEEE Transactions on Antennas and Propagation, May 2011, pp. 1652-1659, vol. 59, No. 5.

Chen et al., "A Decoupling Technique for Increasing the Port Isolation Between Two Strongly Coupled Antennas," IEEE Transactions on Antennas and Propagation, Dec. 2008, pp. 3650-3658, vol. 56, No. 12.

Wong et al., "Three-Antenna MIMO System for WLAN Operation in a PDA Phone," Microwave and Optical Technology Letters, Jul. 2006, pp. 1238-1242, vol. 48, No. 7.

Kim et al., "Design of a Dual-Band MIMO Antenna for Mobile WiMAX Application," Microwave and Optical Technology Letters, Feb. 2011, pp. 410-414, vol. 53, No. 2.

Han et al., "MIMO Antenna Using a Decoupling Network for 4G USB Dongle Application," Microwave and Optical Technology Letters, Nov. 2010, pp. 2551-2554, vol. 52, No. 11.

Coetzee et al., "Compact Multiport Antenna With Isolated Ports," Microwave and Optical Technology Letters, Jan. 2006, pp. 229-232, vol. 50, No. 1.

Ding et al., "A Novel Dual-Band Printed Diversity Antenna for Mobile Terminals," IEEE Transactions on Antennas and Propagation, Jul. 2007, pp. 2088-2096, vol. 55, No. 7.

Liu et al., "A Compact Wideband Planar Diversity Antenna for Mobile Handsets," Microwave and Optical Technology Letters, Jan. 2008, pp. 87-91, vol. 50, No. 1.

Su et al., "Printed Coplanar Two-Antenna Element for 2.4/5 GHz WLAN Operation in a MIMO System," Microwave and Optical Technology Letters, Jun. 2008, pp. 1635-1638, vol. 50, No. 6.

Ethier et al., "MIMO Handheld Antenna Design Approach Using Characteristic Mode Concepts," Microwave and Optical Technology Letters, Jul. 2008, pp. 1724-1727, vol. 50, No. 7.

Cai et al., "A Novel Wideband Diversity Antenna for Mobile Handsets," Microwave and Optical Technology Letters, Jan. 2009, pp. 218-222, vol. 51, No. 1.

Choi et al., "Performance Evaluation of 2×2 MIMO Handset Antenna Arrays for Mobile WiMAX Applications," Microwave and Optical Technology Letters, Jun. 2009, pp. 1558-1561, vol. 51, No. 6.

Saou-Wen Su, "A Three-In-One Diversity Antenna System for 5 GHz WLAN Applications," Microwave and Optical Technology Letters, Oct. 2009, pp. 2477-2481, vol. 51, No. 10.

Kang et al., "Isolation Improvement of 2.4/5.2/5.8 GHz WLAN Internal Laptop Computer Antennas Using Dual-Band Strip Resonator As a Wavetrap," Microwave and Optical Technology Letters, Jan. 2010, pp. 58-64, vol. 52, No. 1.

Bae et al., "Compact Mobile Handset MIMO Antenna for LTE700 Applications," Microwave and Optical Technology Letters, Nov. 2010, pp. 2419-2422, vol. 52, No. 11.

"Office Action of China Counterpart Application", issued on Jan. 30, 2014, p. 1-p. 14.

* cited by examiner

ANTENNA AND COMMUNICATION DEVICE THEREOF

CROSS-REFERENCE TO RELATED APPLICATION

This application claims the priority benefits of U.S. provisional application Ser. No. 61/502,179, filed on Jun. 28, 2011 and Taiwan application serial no. 101107193, filed on Mar. 3, 2012. The entirety of each of the above-mentioned patent applications is hereby incorporated by reference herein and made a part of this specification.

BACKGROUND OF THE DISCLOSURE

1. Field of the Disclosure

The disclosure relates to an antenna and a communication device thereof.

2. Description of Related Art

Along with increasing demands for quality and transmission speed in wireless communication, multi-antenna systems such as a pattern diversity antenna system or a multi-input multi-output antenna (MIMO) system are vigorously developed. In comparison with a single-antenna system widely applied in communication devices, the MIMO antenna system designed with a plurality of transmitting and receiving antennas may improve wireless data transmission speed, which is an important development trend in future communication devices. For example, a wireless local area network (WLAN) system, a universal mobile telecommunication system (UMTS), a worldwide interoperability for microwave access (WiMAX) system and a $4^{th}$ generation mobile communication system such as long term evolution (LTE) system are all developed to be capable of supporting and implementing the MIMO communication technique.

To design a multi-antenna architecture with good energy or ports isolation is a technical challenge that may not easily be achieved. Since electromagnetic energy radiated by multi-antenna elements being operated in a same frequency band may be liable to have severe mutual coupling effects, it is difficult to achieve good energy or ports isolation between the multi-antenna elements. Conventionally such as designing the adjacent antenna elements to be orthogonal to each other, designing protruding or open slot structures on the ground area between nearby antenna elements, or increasing the distance between adjacent antenna elements to improve the energy or ports isolation there between, may in turn additionally increase overall size of the multi-antenna system. Therefore, how to achieve the multi-antenna architecture within a limited usable antenna space of the communication device is an important technical research and development topics of recent years.

SUMMARY OF THE DISCLOSURE

The disclosure is directed to an antenna and a communication device thereof, and some exemplary embodiments of the disclosure may be capable of resolving the technical problem mentioned in the related art.

According to an exemplary embodiment, the disclosure provides an antenna, which includes at least one ground and at least one radiating portion. The ground is disposed on a dielectric substrate, and the radiating portion includes at least one signal source and a closed conductor loop. The closed conductor loop has a first coupling conductor portion and a second coupling conductor portion. The closed conductor loop has a plurality of bending portions to form a three-dimensional structure, and a first coupling gap is formed between the first and the second coupling conductor portions. The closed conductor loop further has a feeding portion and a short-circuit portion to form a second coupling gap between the feeding portion and the short-circuit portion. The feeding portion is electrically connected or coupled to the at least one signal source, and the short-circuit portion is electrically connected or coupled to the ground, the radiating portion makes the antenna to generate an operating band, which is configured to transmit or receive electromagnetic signals of at least one communication band.

According to another exemplary embodiment, the disclosure provides a communication device, which includes at least one transceiver module and at least one antenna. The transceiver module is configured to be at least one signal source. The antenna is electrically connected or coupled to the transceiver module and includes at least one ground and at least one radiating portion. The ground is disposed on a dielectric substrate, and the radiating portion includes a closed conductor loop, wherein the ground is formed on the dielectric substrate through printing or etching method. The closed conductor loop has a first coupling conductor portion and a second coupling conductor portion. The closed conductor loop has a plurality of bending portions to form a three-dimensional structure, and a first coupling gap is formed between the first and the second coupling conductor portions. The closed conductor loop further has a feeding portion and a short-circuit portion to form a second coupling gap between the feeding portion and the short-circuit portion. The feeding portion is electrically connected or coupled to the at least one signal source, and the short-circuit portion is electrically connected or coupled to the ground. The radiating portion makes the antenna to generate an operating band, and the transceiver module is configured to transmit or receives electromagnetic signals of at least one communication band through the antenna.

In order to make the aforementioned and other features and advantages of the disclosure comprehensible, several exemplary embodiments accompanied with figures are described in detail below.

BRIEF DESCRIPTION OF THE DRAWINGS

The accompanying drawings are included to provide a further understanding of the disclosure, and are incorporated in and constitute a part of this specification. The drawings illustrate embodiments of the disclosure and, together with the description, serve to explain the principles of the disclosure.

DETAILED DESCRIPTION OF DISCLOSED EMBODIMENTS

Figure 1A:
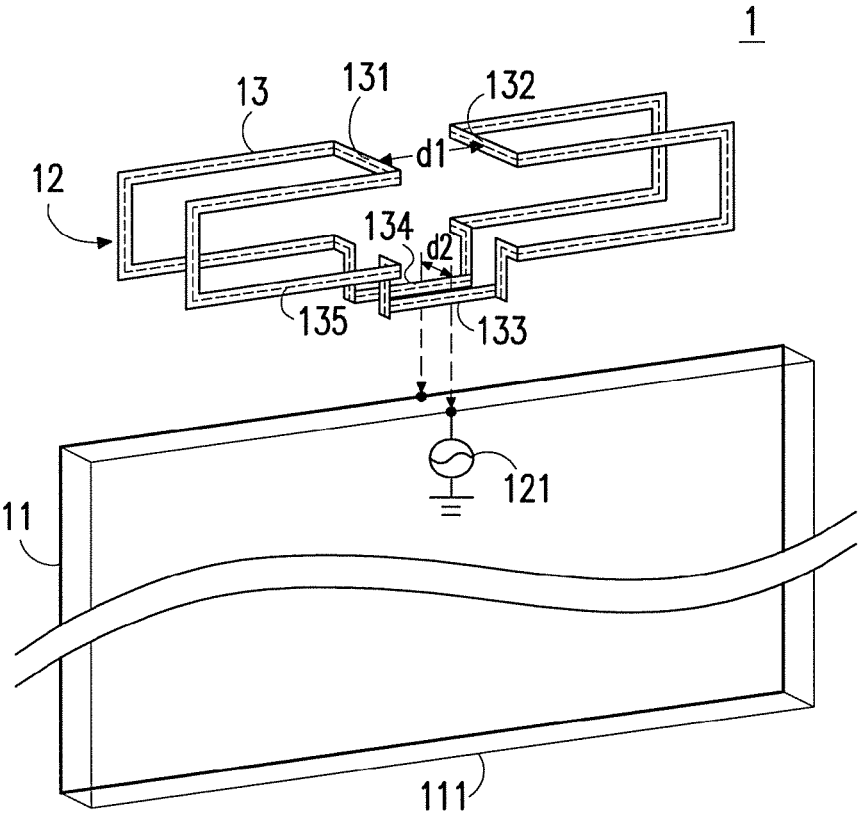
FIG. 1A is a structural schematic diagram of an antenna 1 according to an exemplary embodiment of the disclosure.

Some embodiments of the present application will now be described more fully hereinafter with reference to the accompanying drawings, in which some, but not all embodiments of the application are shown. Indeed, various embodiments of the application may be embodied in many different forms and should not be construed as limited to the embodiments set forth herein; rather, these embodiments are provided so that this disclosure will satisfy applicable legal requirements. Like reference numerals refer to like elements throughout.

The disclosure provides an antenna structure. Exemplary embodiments of the disclosure may be applied to various kinds of communication devices, for example, mobile communication devices, wireless communication devices, mobile computing devices, computer systems, or may be applied to telecommunication equipments, communication equipments, network equipments, or peripheral equipments of computers or networks.

An exemplary embodiment of the disclosure provides an antenna, which includes at least one ground and at least one radiating portion. The ground is disposed on a dielectric substrate, and the radiating portion includes at least one signal source and a closed conductor loop. The closed conductor loop has a first coupling conductor portion and a second coupling conductor portion. The closed conductor loop has a plurality of bending portions to form a three-dimensional structure, and a first coupling gap is formed between the first and the second coupling conductor portions. The closed conductor loop further has a feeding portion and a short-circuit portion to form a second coupling gap between the feeding portion and the short-circuit portion. The feeding portion is electrically connected or coupled to the at least one signal source, and the short-circuit portion is electrically connected or coupled to the ground. In this way, the closed conductor loop may approximately form an equivalent array antenna structure or architecture, which may effectively enhance the impedance bandwidth of an operating band of the antenna. The radiating portion makes the antenna to generate an operating band, which is configured to transmit or receive electromagnetic signals of at least one communication band. The operating band may be excited or formed by a single resonance mode, a dual resonance mode or a multi resonance mode. The closed conductor loop has a long conductor path, and a total path length thereof is between 1.4 wavelengths and 4.2 wavelengths of a center frequency of the operating band. A length of the conductor path between the feeding portion and the short-circuit portion is between a 0.7 wavelength and 2.1 wavelengths of the center frequency of the operating band. The first coupling gap is not more than a 0.25 wavelength of the center frequency of the operating band. The second coupling gap makes the feeding portion and the short-circuit portion to form a mutual coupling structure. Thus, more uniform excited current distribution could be generated at the feeding portion of the radiating portion. Therefore, it may lower variation degrees of the input impedance of the antenna along with frequencies within the operating band, and improve or enhance the impedance matching of the operating band. The second coupling gap is not more than a 0.1 wavelength of the center frequency of the operating band. The first coupling gap may increase the orthogonality of current vectors on the path of the closed conductor loop and current vectors of the feeding portion or the signal feeding terminal of the radiating portion. Thus, near-field coupling energy intensity besides the radiating portion could be effectively reduced. Therefore, other different types of antenna radiating portions could be configured besides the radiating portion. Moreover, within the operating band of the antenna, the radiating portion may have relatively smaller mutual coupling effect with other adjacent antenna radiating portions. Thus, it may achieve a good energy or ports isolation degree easily, which may decrease overall size of the multi-antenna system.

The aforementioned other types of antenna radiating portions may be an antenna radiating portion of planar inverted-F antenna (PIFA) types, inverted-F antenna (IFA) types, monopole antenna types, dipole antenna types, slot antenna types, loop antenna types, helix antenna types, quadrifilar helix antenna (QHA) types, an N-filar helix antenna (NHA) types, other antenna types or other combinations of antenna radiating portions of different antenna types.

FIG. 1A is a structural schematic diagram of an antenna 1 according to an exemplary embodiment of the disclosure. The antenna 1 includes a ground 11 and a radiating portion 12. The ground 11 is disposed on a dielectric substrate 111, and the radiating portion 12 includes at least one signal source 121 and a closed conductor loop 13. The closed conductor loop 13 has a first coupling conductor portion 131 and a second coupling conductor portion 132. The closed conductor loop 13 has a plurality of bending portions to form a three-dimensional structure, and the first coupling conductor portion 131 and the second coupling conductor portion 132 extend towards different directions to form a first coupling gap d1 between the first coupling conductor portion 131 and the second coupling conductor portion 132. The closed conductor loop 13 further has a feeding portion 133 and a short-circuit portion 134 to form a second coupling gap d2 between the feeding portion 133 and the short-circuit portion 134. The feeding portion 133 is electrically connected to the at least one signal source 121, and the short-circuit portion 134 is electrically connected to the ground 11. In this way, the closed conductor loop 13 may approximately form an equivalent array antenna structure, which may effectively enhance an impedance bandwidth of an operating band of the antenna 1. The radiating portion 12 makes the antenna 1 to generate an operating band 1211 (shown in FIG. 1B).

Figure 1B:
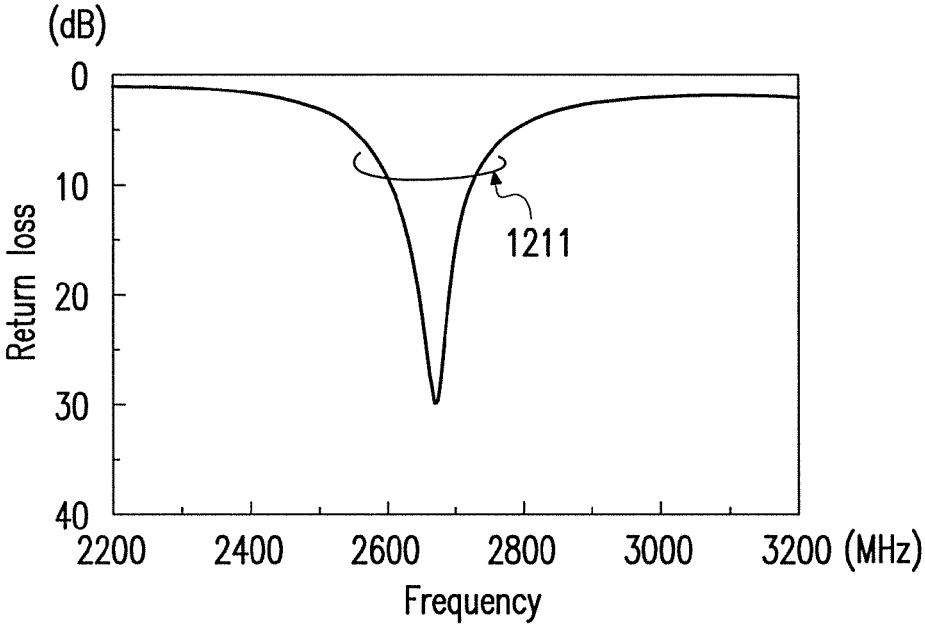
FIG. 1B is a measured return loss diagram of the antenna 1 of FIG. 1A.

FIG. 1B is a measured return loss diagram of the antenna 1 of FIG. 1A, and following sizes are selected for experiment. A length of the ground 11 is approximately 80 mm, and a width thereof is approximately 50 mm. A thickness of the dielectric substrate 111 is approximately 0.8 mm. A length of a total path 135 of the closed conductor loop 13 is approximately 290 mm, and a width thereof is approximately 1 mm. A length of the first and the second coupling conductor portions 131 and 132 is approximately 10 mm. The first coupling gap d1 is approximately 10 mm. The second coupling gap d2 is approximately 1 mm. A length of the feeding portion 133 and the short-circuit portion 134 is approximately 13 mm. The radiating portion 12 makes the antenna 1 to generate the operating band 1211, and the center frequency of the operating band 1211 is approximately 2680 MHz. The operating band 1211 is excited by a single resonance mode. The operating band generated by the radiating portion of the antenna may be excited by the single resonance mode, the dual resonance mode or the multi resonance mode. The length of the total path 135 of the closed conductor loop 13 is approximately 2.6 wavelengths of the center frequency of the operating band 1211, and the length of the conductor path between the feeding portion 133 and the short-circuit portion 134 is approximately 1.3 wavelengths of the center frequency of the operating band 1211. The first coupling gap d1 is not more than 0.25 wavelength of the center frequency of the operating band 1211. The second coupling gap d2 is not more than 0.1 wavelength of the center frequency of the operating band 1211. The length of the total path 135 of the closed conductor loop 13 is between 1.4 wavelengths and 4.2 wavelengths of the center frequency of the operating band 1211. The length of the conductor path between the feeding portion 133 and the short-circuit portion 134 is between 0.7 wavelength and 2.1 wavelengths of the center frequency of the operating band 1211. The second coupling gap d2 makes the feeding portion 133 and the short-circuit portion 134 to form a mutual coupling structure. Thus, more uniform excited current distribution could be generated at the signal feeding terminal or the feeding and short-circuit portions 133, 134 of the radiating portion 12. Therefore, it may lower variation degrees of the input impedance of the antenna along with frequencies within the operating band 1211, and enhance the impedance matching of the operating band 1211 of the antenna 1.

The first coupling gap d1 may increase an orthogonality of current vectors on the path of the closed conductor loop 13 and current vectors of the signal feeding terminal or the feeding and short-circuit portions 133, 134 of the radiating portion 12. Thus, coupling energy intensity besides the radiating portion 12 could be effectively reduced. Therefore, other different types of antenna radiating portions could be configured besides the radiating portion 12. Moreover, within the operating band 1211 of the antenna 1, the radiating portion 12 may have relatively smaller mutual coupling effect with other adjacent antenna radiating portions. Thus, good energy or ports isolation may be achieved, which may decrease overall size of the multi-antenna system. The aforementioned other different types of antenna radiating portions may be an antenna radiating portion of PIFA types, IFA types, monopole antenna types, dipole antenna types, slot antenna types, loop antenna types, helix antenna types, QHA types, NHA types, other antenna types or other combinations of antenna radiating portions of different antenna types. In some embodiments, there may be more than one ground. In some other embodiments, there may be more than one radiating portion.

Moreover, in the present embodiment, the closed conductor loop 13 may be made of different conductor materials, for example, commonly used conductive materials of gold, silver, copper, ion, and so like, but the disclosure is not limited thereto. In other embodiments, the closed conductor loop 13 may be any closed conductor loop, and the conductor material may include metal, alloy or non-metal conductor, for example, carbon nanotube, or other suitable conductor materials or combinations of different conductor materials, but the disclosure is not limited thereto. Moreover, a single material or a combination of different materials may be used to fabricate the closed conductor loop.

Figure 2:
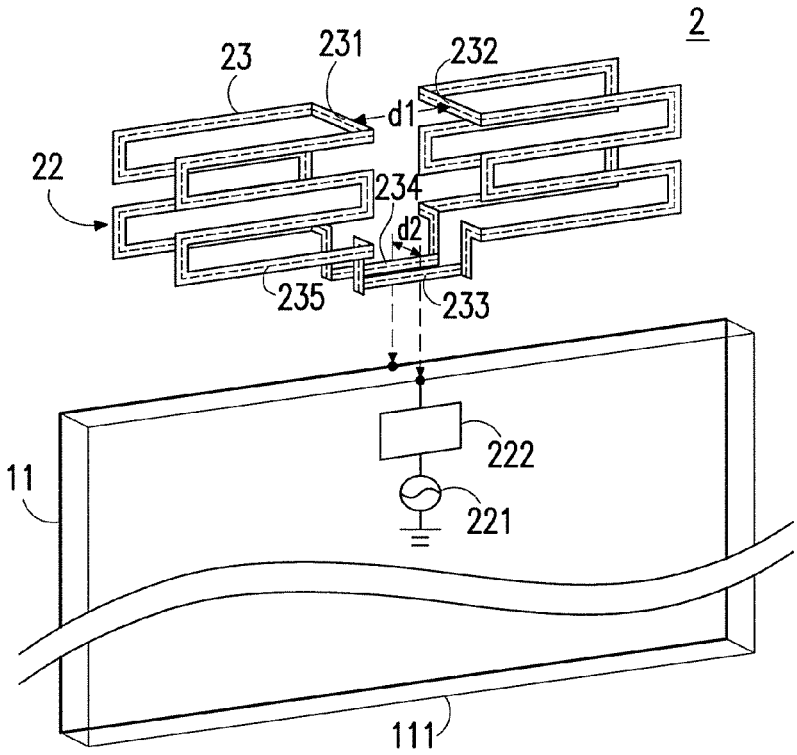
FIG. 2 is a structural schematic diagram of an antenna 2 according to an exemplary embodiment of the disclosure.

FIG. 2 is a structural schematic diagram of an antenna 2 according to an exemplary embodiment of the disclosure. The antenna 2 includes the ground 11 and a radiating portion 22. The ground 11 is disposed on a surface of the dielectric substrate 111, and the radiating portion 22 includes at least one signal source 221 and a closed conductor loop 23. The closed conductor loop 23 has a first coupling conductor portion 231 and a second coupling conductor portion 232. The closed conductor loop 23 has a plurality of bending portions to form a three-dimensional structure, and the first coupling conductor portion 231 and the second coupling conductor portion 232 extend towards different directions to form the first coupling gap d1 between the first coupling conductor portion 231 and the second coupling conductor portion 232. The closed conductor loop 23 further has a feeding portion 233 and a short-circuit portion 234 to form the second coupling gap d2 between the feeding portion 233 and the short-circuit portion 234. The feeding portion 233 is electrically connected or coupled to the at least one signal source 221 through a matching circuit 222, and the short-circuit portion 234 is electrically connected or coupled to the ground 11. In this way, the closed conductor loop 23 may approximately form an equivalent array antenna structure, which may effectively enhance an impedance bandwidth of an operating band of the antenna 2. The radiating portion 22 makes the antenna 2 to generate an operating band, where the operating band may be excited or formed by the single resonance mode, the dual resonance mode or the multi resonance mode. The matching circuit 222 may be a capacitive coupling feeding, an inductive coupling feeding, a low-pass circuit, a high-pass circuit, a band-pass circuit, a band-reject circuit, an L-type circuit or a π-type circuit structures or architectures. The first coupling gap d1 is not more than 0.25 wavelength of the center frequency of the operating band. The second coupling gap d2 is not more than 0.1 wavelength of the center frequency of the operating band. The closed conductor loop 23 has a long conductor path, and a length of a total path 235 thereof is between 1.4 wavelengths and 4.2 wavelengths of the center frequency of the operating band. A length of the conductor path between the feeding portion 233 and the short-circuit portion 234 is between 0.7 wavelength and 2.1 wavelengths of the center frequency of the operating band.

A major difference between the antenna 2 and the antenna 1 lies in that a different bending method is applied on the closed conductor loop 23, and the matching circuit 222 is designed between the feeding portion 233 and the signal source 221 to further adjust the impedance bandwidth of the operating band of the antenna 2. Moreover, the second coupling gap d2 may also make the feeding portion 233 and the short-circuit portion 234 to form a mutual coupling structure. Thus, more uniformly excited current distribution could be generated at a signal feeding terminal of the radiating portion 22. Therefore, it may reduce a variation degree of input impedance of the antenna 2 along with frequencies within the operating band, and thus enhance impedance matching of the operating band of the antenna 2. The first coupling gap d1 may increase orthogonality of a current vector on the path of the closed conductor loop 23 and a current vector of the signal feeding terminal of the radiating portion 22. Thus, it may effectively reduce coupling energy intensity besides the radiating portion 22. Therefore, other different type of antenna radiating portions could be configured besides the radiating portion 22. Moreover, within the operating band of the antenna 2, the radiating portion 22 may have relatively smaller mutual coupling effect with other adjacent antenna radiating portion. Thus, it may achieve a good energy or ports isolation, which may decrease overall size of the multi-antenna system. The aforementioned other different types of antenna radiating portions may be an antenna radiating portion of PIFA types, IFA types, monopole antenna types, dipole antenna types, slot antenna types, loop antenna types, helix antenna types, QHA types, NHA types, other antenna types or other combinations of antenna radiating portions of different antenna types. In some embodiments, there may be more than one ground. In some other embodiments, there may be more than one radiating portion.

Figure 3A:
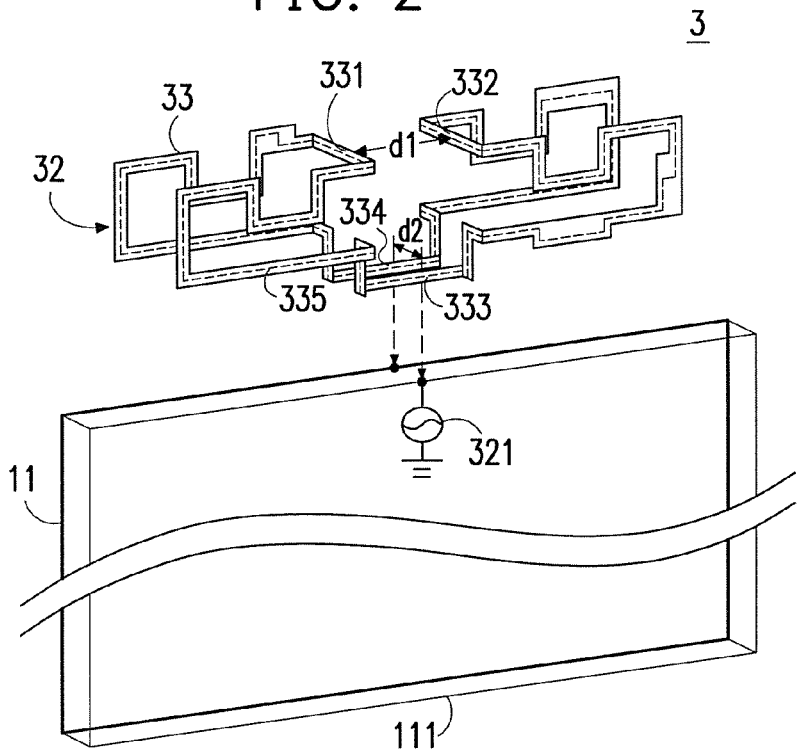
FIG. 3A is a structural schematic diagram of an antenna 3 according to an exemplary embodiment of the disclosure.

FIG. 3A is a structural schematic diagram of an antenna 3 according to an exemplary embodiment of the disclosure. The antenna 3 includes the ground 11 and a radiating portion 32. The ground 11 is disposed on a surface of the dielectric substrate 111, and the radiating portion 32 includes at least one signal source 321 and a closed conductor loop 33. The closed conductor loop 33 has a first coupling conductor portion 331 and a second coupling conductor portion 332. The closed conductor loop 33 has a plurality of bending portions to form a three-dimensional structure, and the first coupling conductor portion 331 and the second coupling conductor portion 332 extend towards different directions to form the first coupling gap d1 between the first coupling conductor portion 331 and the second coupling conductor portion 332. The closed conductor loop 33 further has a feeding portion 333 and a short-circuit portion 334 to form the second coupling gap d2 between the feeding portion 333 and the short-circuit portion 334. The feeding portion 333 is electrically connected to the at least one signal source 321, and the short-circuit portion 334 is electrically connected to the ground 11. In this way, the closed conductor loop 33 may approximately form an equivalent array antenna structure, which may effectively enhance an impedance bandwidth of an operating band of the antenna 3. The radiating portion 32 makes the antenna 3 to generate an operating band 3211 (shown in FIG. 3B). Moreover, in other embodiments, a plurality of paths in the closed conductor loop 33 may have different conductor widths.

Figure 3B:
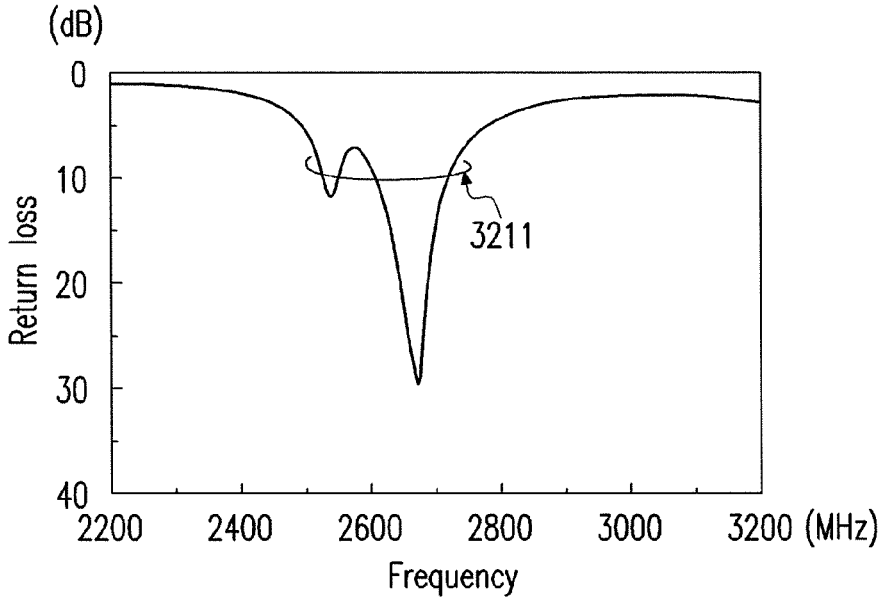
FIG. 3B is a measured return loss diagram of the antenna 3 according to an exemplary embodiment of the disclosure.

FIG. 3B is a measured return loss diagram of the antenna 3 of FIG. 3A, and following sizes are selected for the experiment. A length of the ground 11 is approximately 90 mm, a width thereof is approximately 55 mm. A thickness of the dielectric substrate 111 is approximately 0.8 mm. A length of a total path 335 of the closed conductor loop 33 is approximately 320 mm. A length of the first and the second coupling conductor portions 331 and 332 is approximately 10 mm, and a width thereof is approximately 1 mm. The first coupling gap d1 is approximately 13 mm. A length of the feeding portion 333 and the short-circuit portion 334 is approximately 12 mm, and a width thereof is approximately 1.5 mm. The second coupling gap d2 is approximately 0.8 mm. The radiating portion 32 produces the operating band 3211 for the antenna 3, and the center frequency of the operating band 3211 is approximately 2625 MHz. The operating band 3211 is excited by the dual resonance mode. The operating band generated by the radiating portion of the antenna may be excited or generated by a single resonance mode, a dual resonance mode or a multi resonance mode. The length of the total path 335 of the closed conductor loop 33 is approximately 2.8 wavelengths of the center frequency of the operating band 3211. The first coupling gap d1 is not more than 0.25 wavelength of the center frequency of the operating band 3211. The second coupling gap d2 is not more than 0.1 wavelength of the center frequency of the operating band 3211. The length of the total path 335 of the closed conductor loop 33 is between 1.4 wavelengths and 4.2 wavelengths of the center frequency of the operating band 3211. The length of the conductor path between the feeding portion 333 and the short-circuit portion 334 is between 0.7 wavelength and 2.1 wavelengths of the center frequency of the operating band 3211. A major difference between the antenna 3 and the antenna 1 lies in that a different bending method is applied on the closed conductor loop 33, and the loop conductor paths of the closed conductor loop 33 are designed to have different widths to further adjust the impedance matching of the operating band 3211. Moreover, the second coupling gap d2 may also make the feeding portion 333 and the short-circuit portion 334 to form a mutual coupling structure. Thus, more uniformly excited current distribution could be generated or formed at the signal feeding terminal of the radiating portion 32. Therefore, it may reduce variation degrees of input impedance of the antenna 3 along with frequencies within the operating band 3211, and thus enhance impedance matching of the operating band 3211 of the antenna 3. The first coupling gap d1 may also increase orthogonality of a current vector on the path of the closed conductor loop 33 and a current vector of the feeding and short-circuit portions 333, 334 or the signal feeding terminal of the radiating portion 32. Thus, it may effectively reduce coupling energy intensity besides the radiating portion 32. Therefore, other different types of antenna radiating portions could be configured besides the radiating portion 32. Moreover, within the operating band 3211 of the antenna 3, the radiating portion 32 may have relatively smaller mutual coupling effect with other adjacent antenna radiating portions. Thus, it may achieve good energy or ports isolations, which may decrease overall size of the multi-antenna system. The aforementioned other different types of antenna radiating portions may be an antenna radiating portion of PIFA types, IFA types, monopole antenna types, dipole antenna types, slot antenna types, loop antenna types, helix antenna types, QHA types, NHA types, other antenna types or other combinations of antenna radiating portions of different antenna types. In some embodiments, there may be more than one ground. In some other embodiments, there may be more than one radiating portion.

In the present embodiment, the operating band 3211 of the antenna 3 may be used to transmit or receive electromagnetic signals of a long term evolution (LTE) 2500 communication band. However, FIG. 3B is only used here to illustrate an example that the operating band generated by the antenna 3 may be used to transmit or receive electromagnetic signals of at least one communication band, which is not used to limit the disclosure. The operating band generated by the antenna 3 may also be used to transmit or receive electromagnetic signals applied in a global system for mobile communications (GSM) system, a universal mobile telecommunications system (UMTS), a worldwide interoperability for microwave access (WiMAX) system, a digital television broadcasting (DTV) system, a global positioning system (GPS), a wireless wide area network (WWAN) system, a wireless local area network (WLAN) system, an ultra-wideband (UWB) system, a wireless personal area network (WPAN), a global positioning system (GPS), a satellite communication system, other suitable system types or other wireless or mobile communication band applications.

Figure 4:
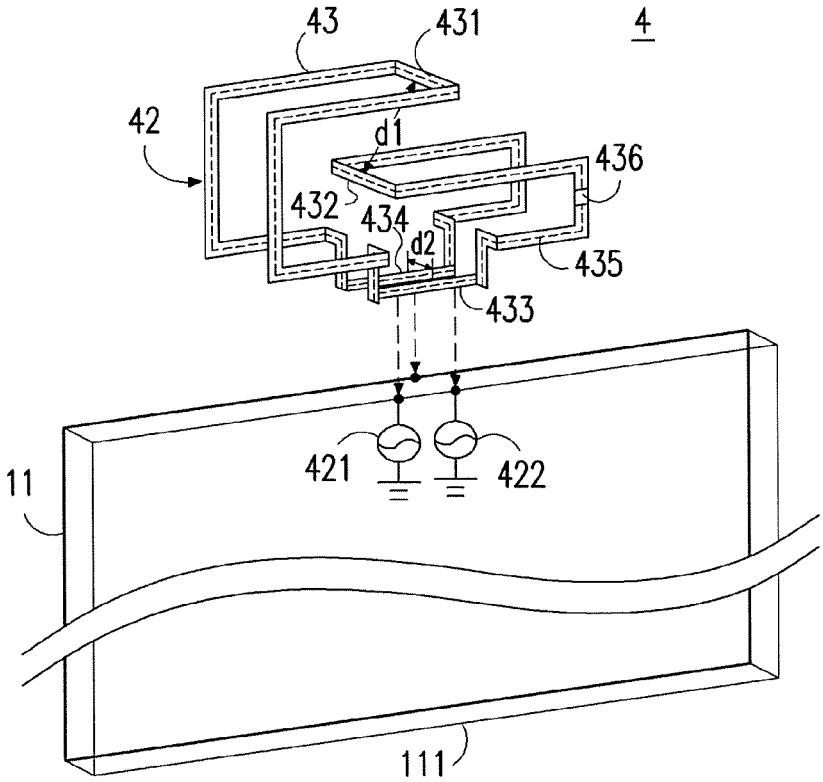
FIG. 4 is a structural schematic diagram of an antenna 4 according to an exemplary embodiment of the disclosure.

FIG. 4 is a structural schematic diagram of an antenna 4 according to an exemplary embodiment of the disclosure. The antenna 4 includes the ground 11 and a radiating portion 42. The ground 11 is disposed on a surface of the dielectric substrate 111, and the radiating portion 42 includes a closed conductor loop 43 and signal sources 421 and 422. The closed conductor loop 43 has a first coupling conductor portion 431 and a second coupling conductor portion 432. The closed conductor loop 43 has a plurality of bending portions to form a three-dimensional structure, and the first coupling conductor portion 431 and the second coupling conductor portion 432 extend towards different directions to form the first coupling gap d1 between the first coupling conductor portion 431 and the second coupling conductor portion 432. The closed conductor loop 43 further has a feeding portion 433 and a short-circuit portion 434 to form the second coupling gap d2 between the feeding portion 433 and the short-circuit portion 434. The feeding portion 433 is electrically connected or coupled to the signal source 421 and the signal source 422, and the short-circuit portion 434 is electrically connected or coupled to the ground 11. In this way, the closed conductor loop 43 may approximately form an equivalent array antenna structure, which may effectively enhance an impedance bandwidth of an operating band of the antenna 4. The radiating portion 42 makes the antenna 4 to generate the operating band, where the operating band may be excited or formed by the single resonance mode, the dual resonance mode or the multi resonance mode. The first coupling gap d1 is not more than 0.25 wavelength of the center frequency of the operating band. The second coupling gap d2 is not more than 0.1 wavelength of the center frequency of the operating band. A length of a total path 435 of the closed conductor loop 43 is between 1.4 wavelengths and 4.2 wavelengths of the center frequency of the operating band. A length of the conductor path between the feeding portion 433 and the short-circuit portion 434 is between 0.7 wavelength and 2.1 wavelengths of the center frequency of the operating band.

A major difference between the antenna 4 and the antenna 1 lies in that a different bending method is applied on the closed conductor loop 43, and a lumped chip inductor 436 is disposed on a conductor path of the closed conductor loop 43 to achieve miniaturization of the antenna 4. Additionally, the feeding portion 433 is simultaneously connected or coupled to the two signal sources 421 and 422 to achieve a multi-input multi-output (MIMO) or a pattern space diversity multi-antenna system operation. Moreover, the second coupling gap d2 may also make the feeding portion 433 and the short-circuit portion 434 to form a mutual coupling structure. Thus, more uniform excited current distribution could also be generated, at a signal feeding terminal of the signal sources 421 and 422, on radiating portion 42. Therefore, it may reduce variation degrees of input impedance of the antenna 4 along with frequency within the operating band, and thus enhance impedance matching of the operating band generated by the antenna 4. The first coupling gap d1 may increase orthogonality of current vectors on the path of the closed conductor loop 43 and current vectors of the signal feeding terminal of the radiating portion 42. Thus, it may effectively reduce coupling energy intensity besides the radiating portion 42. Therefore, other different type of antenna radiating portions may be configured besides the radiating portion 42. Moreover, within the operating band of the antenna 4, the radiating portion 42 may have relatively smaller mutual coupling effect with other adjacent antenna radiating portions. Thus, it may achieve a good energy or ports isolation, which may decrease overall size of the multi-antenna system. The aforementioned other different types of antenna radiating portions may be an antenna radiating portion of PIFA types, IFA types, monopole antenna types, dipole antenna types, slot antenna types, loop antenna types, helix antenna types, QHA types, NHA types, other antenna types or other combinations of antenna radiating portions of different antenna types. In some embodiments, there may be more than one ground. In some other embodiments, there may be more than one radiating portion. The lumped chip inductor 436 may also be replaced by a lumped chip capacitor to adjust the impedance matching of the operating band generated or formed by the radiating portion 42. Besides, the lumped chip inductor 436 could also be replaced by inductors or capacitors of distributed or lumped types.

Figure 5:
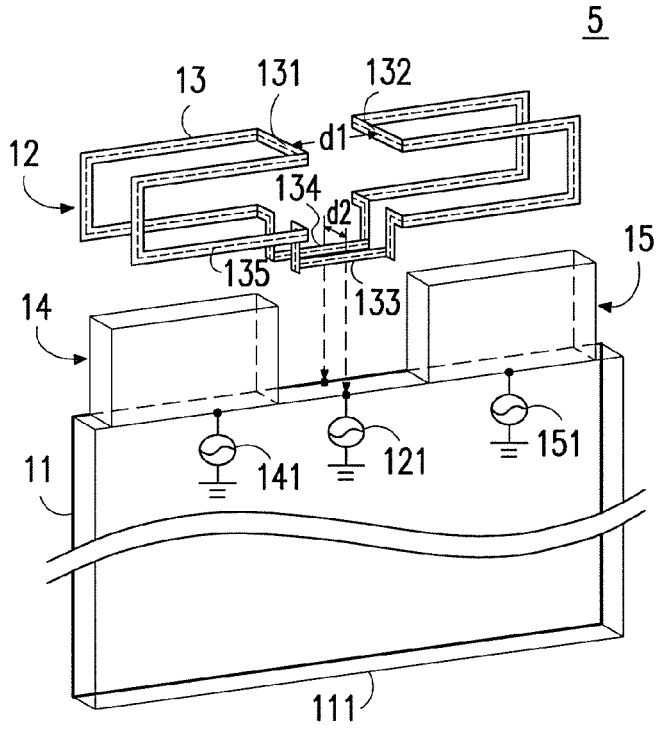
FIG. 5 is a structural schematic diagram of an antenna 5 according to an exemplary embodiment of the disclosure.

FIG. 5 is a structural schematic diagram of an antenna 5 according to an exemplary embodiment of the disclosure. The antenna 5 includes the ground 11 and the radiating portion 12. The ground 11 is disposed on a surface of the dielectric substrate 111, and the radiating portion 12 includes the closed conductor loop 13 and the at least one signal source 121. The closed conductor loop 13 has the first coupling conductor portion 131 and the second coupling conductor portion 132. The closed conductor loop 13 has a plurality of bending portions to form a three-dimensional structure, and the first coupling conductor portion 131 and the second coupling conductor portion 132 extend towards different directions to form the first coupling gap d1 between the first coupling conductor portion 131 and the second coupling conductor portion 132. The closed conductor loop 13 further has the feeding portion 133 and the short-circuit portion 134 to form the second coupling gap d2 between the feeding portion 133 and the short-circuit portion 134. The feeding portion 133 is electrically connected or coupled to the at least one signal source 121, and the short-circuit portion 134 is electrically connected coupled to the ground 11. In this way, the closed conductor loop 13 may approximately form an equivalent two antenna array structure or architecture, which may effectively enhance an impedance bandwidth of an operating band of the antenna 5. The radiating portion 12 makes the antenna 5 to generate the operating band, where the operating band may be excited by a single resonance mode, a dual resonance mode or a multi resonance mode. The first coupling gap d1 is not more than 0.25 wavelength of the center frequency of the operating band. The second coupling gap d2 is not more than 0.1 wavelength of the center frequency of the operating band. A length of the total path 135 of the closed conductor loop 13 is between 1.4 wavelengths and 4.2 wavelengths of the center frequency of the operating band. A length of the conductor path between the feeding portion 133 and the short-circuit portion 134 is between 0.7 wavelength and 2.1 wavelengths of the center frequency of the operating band.

A major difference between the antenna 5 and the antenna 1 is that a radiating portion 14 and a radiating portion 15 are respectively designed at two sides of the radiating portion 12 of the antenna 5 to achieve the MIMO or the pattern space diversity multi-antenna system. The radiating portion 14 is electrically connected or coupled to a signal source 141, and the radiating portion 15 is electrically connected or coupled to a signal source 151. The second coupling gap d2 of the radiating portion 12 may make the feeding portion 133 and the short-circuit portion 134 to form a mutual coupling structure. Thus, more uniform excited current distribution could be generated, at a signal feeding terminal of the signal source 121, on the radiating portion 12. Therefore, it may reduce variation degrees of input impedance of the radiating portion 12 along with frequencies within the operating band, and thus enhance impedance matching of the operating band of the antenna 5. The first coupling gap d1 may increase orthogonality of a current vector on the path of the closed conductor loop 13 and a current vector of the feeding and short-circuit portions 133, 134 or the signal feeding terminal of the radiating portion 12. Thus, it may effectively reduce coupling energy intensity besides the radiating portion 12. Therefore, other different types of antenna radiating portions may be configured besides the radiating portion 12. Moreover, within the operating band of the antenna 5, the radiating portion 12 may have relatively smaller mutual coupling effect with other adjacent antenna radiating portion. Thus, it may achieve good energy or ports isolations, which may decrease overall size of the multi-antenna system. The aforementioned other different types of antenna radiating portions may be an antenna radiating portion of PIFA types, IFA types, monopole antenna types, dipole antenna types, slot antenna types, loop antenna types, helix antenna types, QHA types, NHA types, other antenna types or other combinations of antenna radiating portions of different antenna types. In some embodiments, there may be more than one ground. In some other embodiments, there may be more than one radiating portion.

Figure 6A:
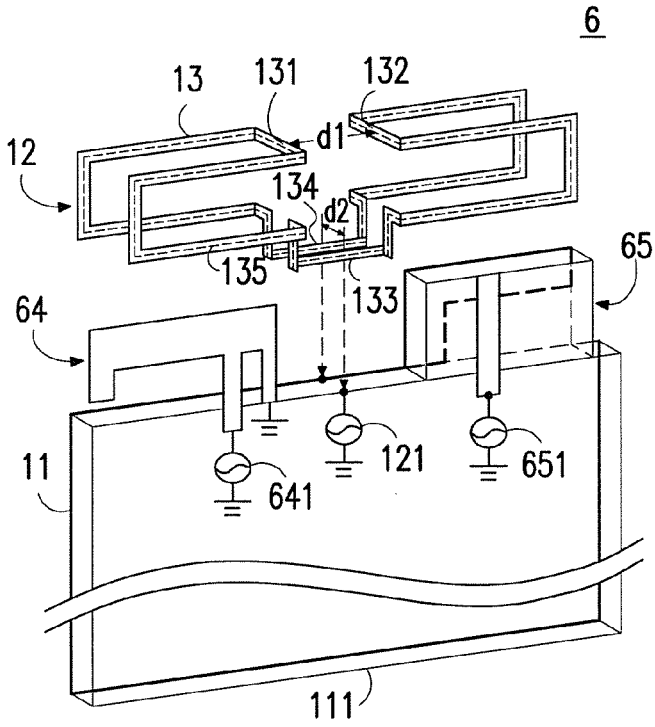
FIG. 6A is a structural schematic diagram of an antenna 6 according to an exemplary embodiment of the disclosure.

FIG. 6A is a structural schematic diagram of an antenna 6 according to an exemplary embodiment of the disclosure. The antenna 6 includes the ground 11 and the radiating portion 12. The ground 11 is disposed on a surface of the dielectric substrate 111, and the radiating portion 12 includes the closed conductor loop 13 and the at least one signal source 121. The closed conductor loop 13 has the first coupling conductor portion 131 and the second coupling conductor portion 132. The closed conductor loop 13 has a plurality of bending portions to form a three-dimensional structure, and the first coupling conductor portion 131 and the second coupling conductor portion 132 extend towards different directions to form the first coupling gap d1 between the first coupling conductor portion 131 and the second coupling conductor portion 132. The closed conductor loop 13 further has the feeding portion 133 and the short-circuit portion 134 to form the second coupling gap d2 between the feeding portion 133 and the short-circuit portion 134. The feeding portion 133 is electrically connected to the at least one signal source 121, and the short-circuit portion 134 is electrically connected to the ground 11. In this way, the closed conductor loop 13 may approximately form an equivalent array antenna structure, which may effectively enhance an impedance bandwidth of an operating band. The radiating portion 12 makes the antenna 6 to generate the operating band 1211 (shown in FIG. 6B), where the operating band 1211 may be excited by a dual resonance mode. In other embodiment, the operating band of the antenna 6 may be excited by a single resonance mode or a multi resonance mode. The first coupling gap d1 is not more than 0.25 wavelength of the center frequency of the operating band 1211. The second coupling gap d2 is not more than 0.1 wavelength of the center frequency of the operating band 1211. A length of the total path 135 of the closed conductor loop 13 is between 1.4 wavelengths and 4.2 wavelengths of the center frequency of the operating band 1211. A length of the conductor path between the feeding portion 133 and the short-circuit portion 134 is between 0.7 wavelength and 2.1 wavelengths of the center frequency of the operating band 1211.

A major difference between the antenna 6 and the antenna 1 is that a radiating portion 64 and a radiating portion 65 are respectively designed at two sides of the radiating portion 12 of the antenna 6 to achieve the MIMO or the pattern space diversity multi-antenna system. The radiating portion 64 and the radiating portion 65 are respectively antenna radiating portions of a PIFA and a slot antenna, and are electrically connected or coupled to a signal source 641 and a signal source 651, respectively. The second coupling gap d2 of the radiating portion 12 may make the feeding portion 133 and the short-circuit portion 134 to form a mutual coupling structure. Thus, more uniformly excited current distribution could be generated, at a signal feeding terminal of the signal source 121, on the radiating portion 12. Therefore, it may reduce variation degrees of input impedance of the radiating portion 12 along with frequencies within the operating band 1211 (shown in FIG. 6B), and enhance impedance matching of the operating band 1211. The first coupling gap d1 may increase orthogonality of a current vector on the path of the closed conductor loop 13 and a current vector of the signal feeding terminal of the radiating portion 12. Thus, it may effectively reduce coupling energy intensity besides the radiating portion 12. Moreover, within the operating band, the radiating portion 12 may have relatively smaller mutual coupling effect with the adjacent antenna radiating portion 64 and the antenna portion 65, though the disclosure is not limited thereto. The antenna radiating portions 64 and 65 may be antenna radiating portions of other types of antennas such as PIFA types, IFA types, monopole antenna types, dipole antenna types, slot antenna types, loop antenna types, helix antenna types, QHA types, NHA types, other suitable antenna types, or combinations of antenna radiating portions of different antenna types. In some embodiments, there may be more than one ground. In some other embodiments, there may be more than one radiating portion.

Figure 6B:
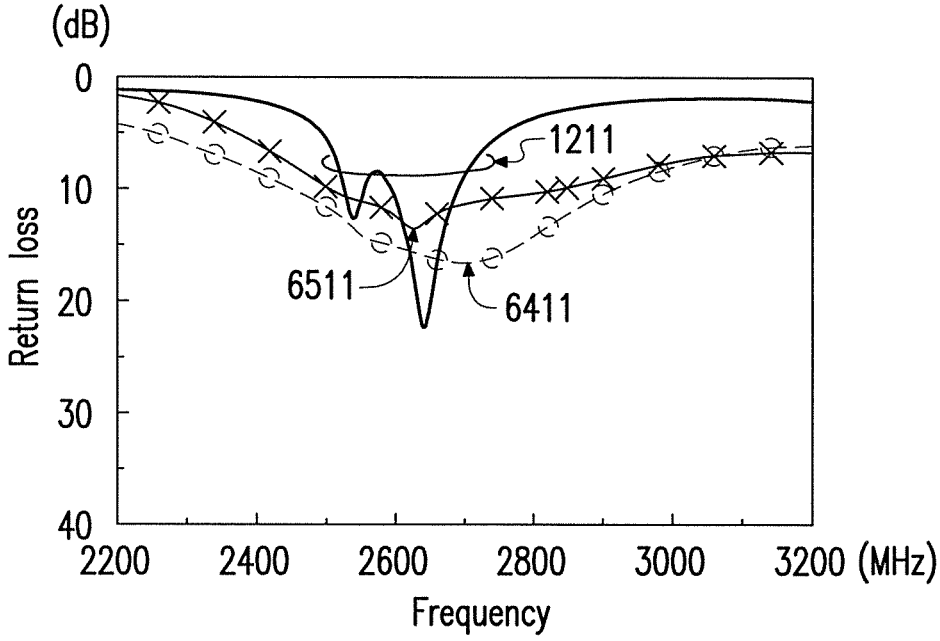
FIG. 6B is a measured return loss diagram of a radiating portion 12, a radiating portion 64 and a radiating portion 65 of the antenna 6 of FIG. 6A.
Figure 6C:
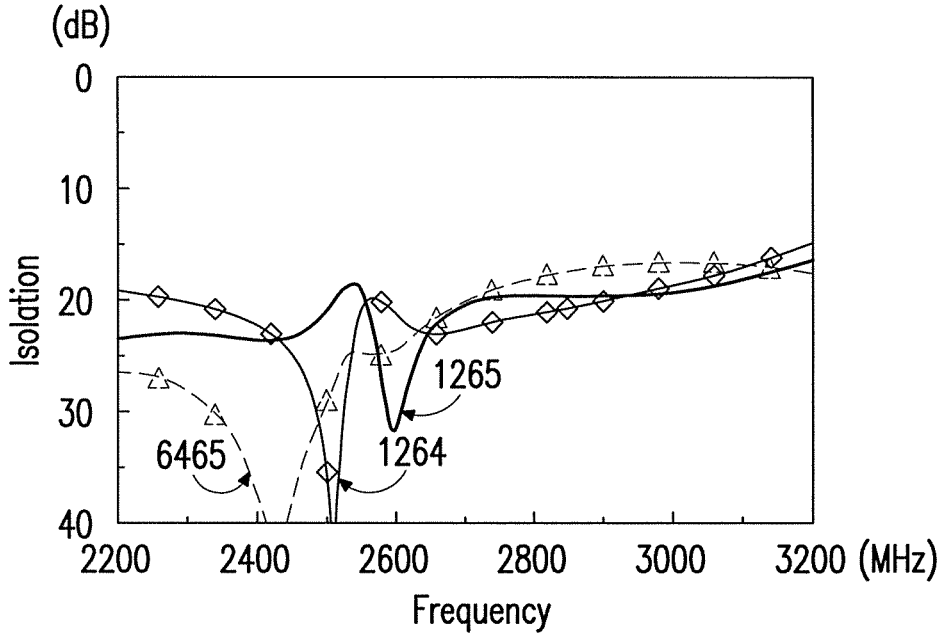
FIG. 6C is a measured isolation curve diagram of a radiating portion 12, a radiating portion 64 and a radiating portion 65 of the antenna 6 of FIG. 6A.

FIG. 6B is a measured return loss diagram of the radiating portion 12, the radiating portion 64 and the radiating portion 65 of the antenna 6 of FIG. 6A. Experiment sizes of the radiating portion 12 are the same as that of FIG. 1A. The radiating portion 12 may make the antenna 6 to generate the operating band 1211, the radiating portion 64 may make the antenna 6 to generate an operating band 6411, and the radiating portion 65 may make the antenna 6 to generate an operating band 6511. FIG. 6C is a measured isolation curve diagram of the radiating portion 12, the radiating portion 64 and the radiating portion 65 of the antenna 6 of FIG. 6A. A curve 1264 is an isolation curve between the radiating portion 12 and the radiating portion 64, a curve 1265 is an isolation curve between the radiating portion 12 and the radiating portion 65, and a curve 6465 is an isolation curve between the radiating portion 64 and the radiating portion 65. According to FIG. 6C, it may be understood that since the first coupling gap d1 may effectively reduce the coupling energy intensity of besides the radiating portion 12, the radiating portion 12 may have a good isolation performance with the radiating portion 64 and the radiating portion 65 located adjacent to the sides of the radiating portion 12 within the operating band 1211. For example, within the operating band 1211 excited by the radiating portion 12, isolation between the radiating portion 12 and the radiating portions 64 and 65 located adjacent to the sides of the radiating portion 12 is better than 15 dB.

In the present embodiment, the operating band 1211 generated by the radiating portion 12 of the antenna 6 may be used to transmit or receive electromagnetic signals of the LTE2500 communication band. The operating bands 6411 and 6511 respectively generated by the radiating portion 64 and the radiating portion 65 of the antenna 6 may be used to transmit or receive electromagnetic signals of a WLAN2400 and the LTE2500 communication band. FIG. 6B is only used here to illustrate an example that the operating band generated by the radiating portion 12 of the antenna 6 may be used to transmit or receive electromagnetic signals of at least one communication band, which is not used to limit the disclosure. The operating band generated by the radiating portion 12 of the antenna 6 may also be used to transmit or receive electromagnetic signals applied of a GSM system, a UMTS, a WiMAX system, a DTV broadcasting system, a GPS, a WWAN system, a WLAN system, an UWB system, a WPAN, a GPS, a satellite communication system, other suitable system types, or other wireless or mobile communication band applications.

Figure 7:
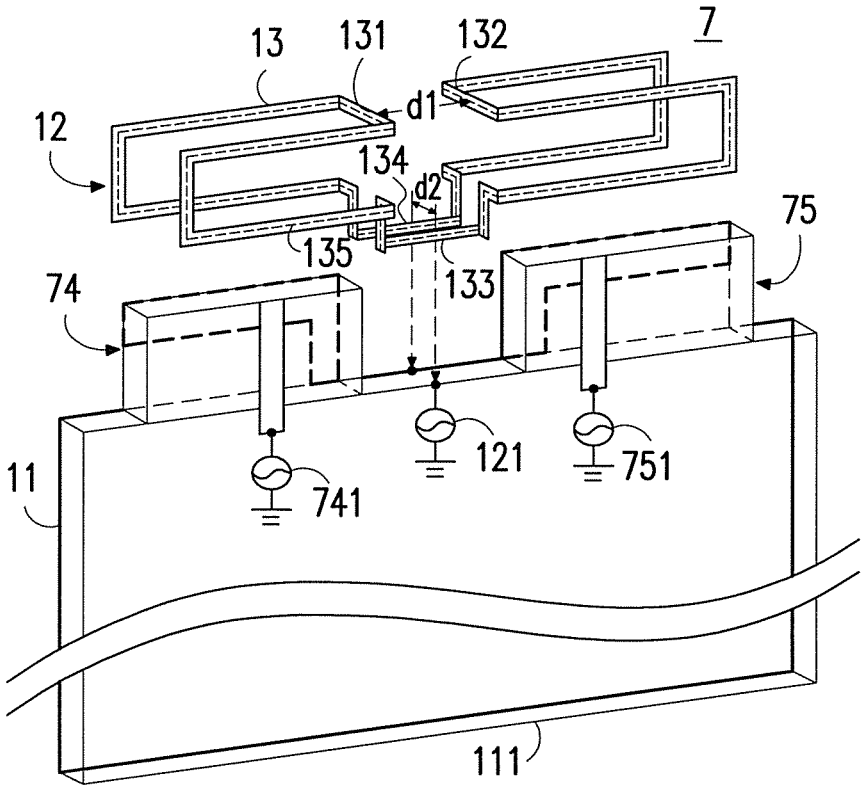
FIG. 7 is a structural schematic diagram of an antenna 7 according to an exemplary embodiment of the disclosure.

FIG. 7 is a structural schematic diagram of an antenna 7 according to an exemplary embodiment of the disclosure. The antenna 7 includes the ground 11 and the radiating portion 12. The ground 11 is disposed on a surface of the dielectric substrate 111, and the radiating portion 12 includes the closed conductor loop 13 and the at least one signal source 121. The closed conductor loop 13 has the first coupling conductor portion 131 and the second coupling conductor portion 132. The closed conductor loop 13 has a plurality of bending portions to form a three-dimensional structure, and the first coupling conductor portion 131 and the second coupling conductor portion 132 extend towards different directions to form the first coupling gap d1 between the first coupling conductor portion 131 and the second coupling conductor portion 132. The closed conductor loop 13 further has the feeding portion 133 and the short-circuit portion 134 to form the second coupling gap d2 between the feeding portion 133 and the short-circuit portion 134. The feeding portion 133 is electrically connected to the at least one signal source 121, and the short-circuit portion 134 is electrically connected to the ground 11. In this way, the closed conductor loop 13 is approximately equivalent to an array antenna structure, which may effectively increase an impedance bandwidth of an operating band. The radiating portion 12 makes the antenna 7 to generate the operating band, where the operating band may be excited by the single resonance mode, the dual resonance mode or the multi resonance mode. The first coupling gap d1 is not more than 0.25 wavelength of the center frequency of the operating band 1211. The second coupling gap d2 is not more than 0.1 wavelength of the center frequency of the operating band. The closed conductor loop 13 has a long conductor path, and a length of the total path 135 of the closed conductor loop 13 is between 1.4 wavelengths and 4.2 wavelengths of the center frequency of the operating band. A length of the conductor path between the feeding portion 133 and the short-circuit portion 134 is between 0.7 wavelength and 2.1 wavelengths of the center frequency of the operating band.

A major difference between the antenna 7 and the antenna 1 is that a radiating portion 74 and a radiating portion 75 are respectively designed at two sides of the radiating portion 12 of the antenna 6 to achieve the MIMO or the pattern space diversity multi-antenna system. Both the radiating portion 74 and the radiating portion 75 are antenna radiating portions of slot antennas, and are electrically connected to a signal source 741 and a signal source 751, respectively. The second coupling gap d2 of the radiating portion 12 may make the feeding portion 133 and the short-circuit portion 134 to form a mutual coupling structure. Thus, more uniformly excited current distribution could be generated, at the signal feeding terminal of the signal source 121, on the radiating portion 12. Therefore, it may reduce a variation degree of an antenna input impedance along with frequencies within the operating band, and enhance impedance matching of the operating band. The first coupling gap d1 may increase orthogonality of a current vector on the path of the closed conductor loop 13 and a current vector of the signal feeding terminal of the radiating portion 12. Thus, it may effectively reduce coupling energy intensity besides the radiating portion 12. Therefore, within the operating band, the radiating portion 12 may have relatively smaller mutual coupling effect with the adjacent antenna radiating portion 74 and the antenna portion 75, though the disclosure is not limited thereto. The antenna radiating portions 74 and 75 may be antenna radiating portions of other antenna types such as PIFA types, IFA types, monopole antenna types, dipole antenna types, slot antenna types, loop antenna types, helix antenna types, QHA types, NHA types, other antenna types, or other combinations of antenna radiating portions of different antenna types. In some embodiments, there may be more than one ground. In some other embodiments, there may be more than one radiating portion.

Figure 8:
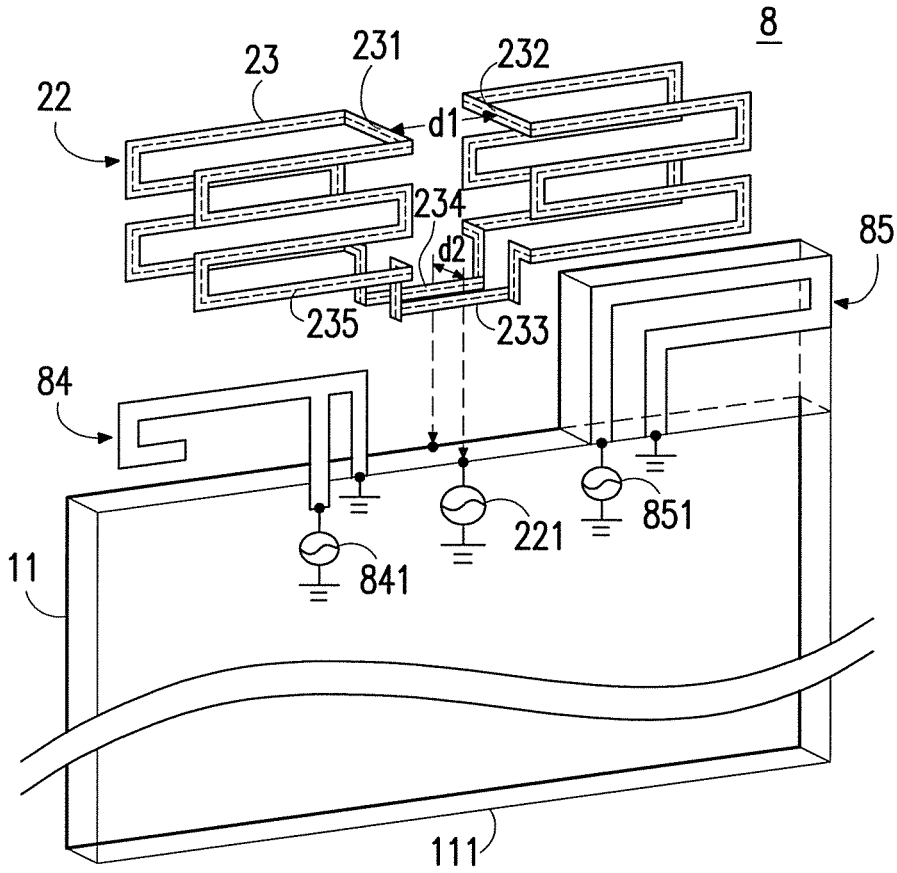
FIG. 8 is a structural schematic diagram of an antenna 8 according to an exemplary embodiment of the disclosure.

FIG. 8 is a structural schematic diagram of an antenna 8 according to an exemplary embodiment of the disclosure. The antenna 8 includes the ground 11 and the radiating portion 22. The ground 11 is disposed on a surface of the dielectric substrate 111, and the radiating portion 22 includes the closed conductor loop 23 and at least one signal source 221. The closed conductor loop 23 has the first coupling conductor portion 231 and the second coupling conductor portion 232. The closed conductor loop 23 has a plurality of bending portions to form a three-dimensional structure, and the first coupling conductor portion 231 and the second coupling conductor portion 232 extend towards different directions to form the first coupling gap d1 between the first coupling conductor portion 231 and the second coupling conductor portion 232. The closed conductor loop 23 further has the feeding portion 233 and the short-circuit portion 234 to form the second coupling gap d2 between the feeding portion 233 and the short-circuit portion 234. The feeding portion 233 is electrically connected to the at least one signal source 221, and the short-circuit portion 234 is electrically connected to the ground 11. In this way, the closed conductor loop 23 is approximately equivalent to an array antenna structure or architecture, which may effectively increase an impedance bandwidth of an operating band. The radiating portion 22 makes the antenna 8 to generate the operating band, where the operating band may be excited by a single resonance mode, a dual resonance mode or a multi resonance mode. The first coupling gap d1 is not more than 0.25 wavelength of the center frequency of the operating band. The second coupling gap d2 is not more than 0.1 wavelength of the center frequency of the operating band. A length of a total path 235 of the closed conductor loop 23 is between 1.4 wavelengths and 4.2 wavelengths of the center frequency of the operating band. A length of the conductor path between the feeding portion 233 and the short-circuit portion 234 is between 0.7 wavelength and 2.1 wavelengths of the center frequency of the operating band.

A major difference between the antenna 8 and the antenna 1 lies in that a different bending method is applied on the closed conductor loop 23, and a radiating portion 84 and a radiating portion 85 are respectively designed at two sides of the radiating portion 22 to achieve the MIMO or the pattern space diversity multi-antenna system. The radiating portion 84 is an antenna radiating portion of a PIFA, and is electrically connected or coupled to a signal source 841. The radiating portion 85 is an antenna radiating portion of a loop antenna, and is electrically connected or coupled to a signal source 851. The second coupling gap d2 of the radiating portion 22 may make the feeding portion 233 and the short-circuit portion 234 to form a mutual coupling structure. Thus, more uniformly excited current distribution could be generated, at the signal feeding terminal of the signal source 221, on the radiating portion 22. Therefore, it may reduce a variation degree of an antenna input impedance along with frequency within the operating band, and enhance impedance matching of the operating band. The first coupling gap d1 may increase orthogonality of a current vector on the path of the closed conductor loop 23 and a current vector of the signal feeding terminal of the radiating portion 22. Therefore, it may effectively reduce coupling energy intensity besides the radiating portion 22. Thus, within the operating band, the radiating portion 22 may have relatively smaller mutual coupling effect with the adjacent antenna radiating portion 84 and the antenna portion 85, though the disclosure is not limited thereto. The antenna radiating portions 84 and 85 may be antenna radiating portions of other antenna types such as PIFA types, IFA types, monopole antenna types, dipole antenna types, slot antenna types, loop antenna types, helix antenna types, QHA types, NHA types, other antenna types, or other combinations of antenna radiating portions of different antenna types. In some embodiments, there may be more than one ground. In some other embodiments, there may be more than one radiating portion.

Figure 9:
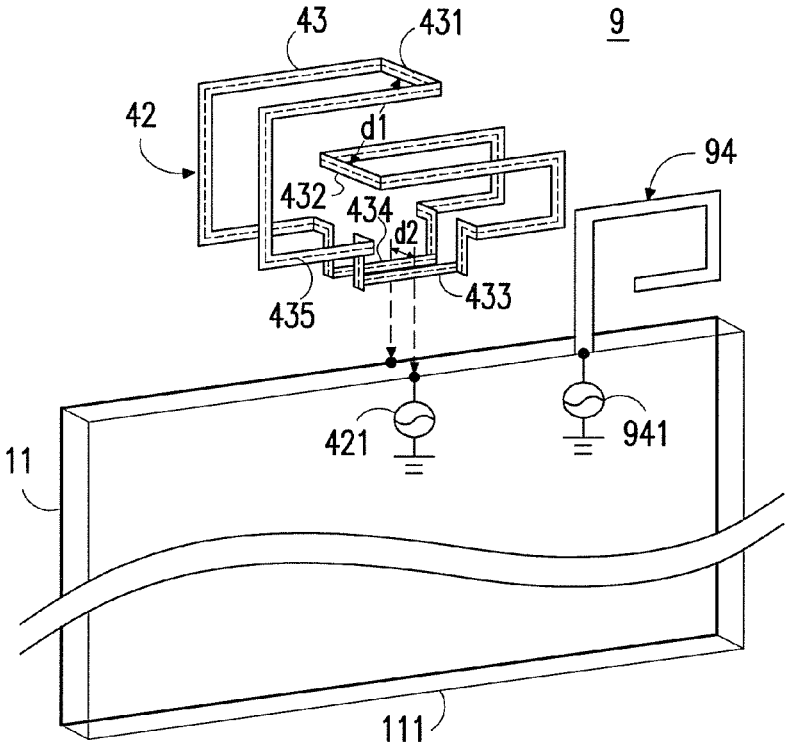
FIG. 9 is a structural schematic diagram of an antenna 9 according to an exemplary embodiment of the disclosure.

FIG. 9 is a structural schematic diagram of an antenna 9 according to an exemplary embodiment of the disclosure. The antenna 9 includes the ground 11 and a radiating portion 42. The ground 11 is disposed on a surface of the dielectric substrate 111, and the radiating portion 42 includes a closed conductor loop 43 and at least one signal source 421. The closed conductor loop 43 has a first coupling conductor portion 431 and a second coupling conductor portion 432. The closed conductor loop 43 has a plurality of bending portions to form a three-dimensional structure, and the first coupling conductor portion 431 and the second coupling conductor portion 432 extend towards different directions to form the first coupling gap d1 between the first coupling conductor portion 431 and the second coupling conductor portion 432. The closed conductor loop 43 further has the feeding portion 433 and the short-circuit portion 434 to form the second coupling gap d2 between the feeding portion 433 and the short-circuit portion 434. The feeding portion 433 is electrically connected to the at least one signal source 421, and the short-circuit portion 434 is electrically connected to the ground 11. In this way, the closed conductor loop 43 may approximately for an equivalent array antenna structure, which may effectively enhance an impedance bandwidth of an operating band. The radiating portion 42 makes the antenna 9 to generate the operating band, where the operating band may be excited by the single resonance mode, the dual resonance mode or the multi resonance mode.

The first coupling gap d1 is not more than 0.25 wavelength of the center frequency of the operating band. The second coupling gap d2 is not more than 0.1 wavelength of the center frequency of the operating band. A length of the total path 435 of the closed conductor loop 43 is between 1.4 wavelengths and 4.2 wavelengths of the center frequency of the operating band. A length of the conductor path between the feeding portion 433 and the short-circuit portion 434 is between 0.7 wavelength and 2.1 wavelengths of the center frequency of the operating band. The second coupling gap d2 makes the feeding portion 433 and the short-circuit portion 434 to form a mutual coupling structure. Thus, more uniformly excited current distribution could be generated at a signal feeding terminal of the radiating portion 42. Thus, it may reduce a variation degree of an antenna input impedance along with frequency within the operating band, and enhance impedance matching of the operating band.

A major difference between the antenna 9 and the antenna 1 lies in that a different bending method is applied on the closed conductor loop 43, and a radiating portion 94 is designed at a side of the radiating portion 42 to achieve the MIMO or the pattern space diversity multi-antenna system. The radiating portion 94 is an antenna radiating portion of a monopole antenna, and is electrically connected to a signal source 941. The first coupling gap d1 may increase orthogonality of a current vector on the path of the closed conductor loop 43 and a current vector of the signal feeding terminal of the radiating portion 42. Thus, it may effectively reduce coupling energy intensity besides the radiating portion 42. Therefore, within the operating band, the radiating portion 42 may have relatively smaller mutual coupling effect with the adjacent antenna radiating portion 94. As a result, it may achieve better isolation between the radiating portion 42 and the radiating portion 94. However, the disclosure is not limited thereto, and the radiating portion 94 may be antenna radiating portions of other types of antennas such as PIFA types, IFA types, monopole antenna types, dipole antenna types, slot antenna types, loop antenna types, helix antenna types, QHA types, NHA types, or other antenna types, or other combinations of antenna radiating portions of different antenna types. In some embodiments, there may be more than one ground. In some other embodiments, there may be more than one radiating portion.

Figure 10:
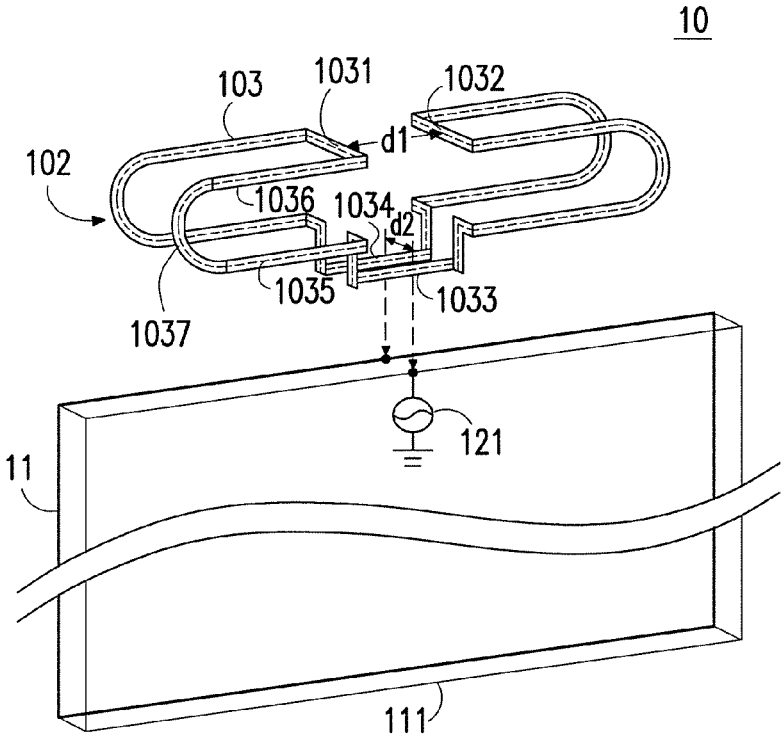
FIG. 10 is a structural schematic diagram of an antenna 10 according to an exemplary embodiment of the disclosure.

FIG. 10 is a structural schematic diagram of an antenna 10 according to an exemplary embodiment of the disclosure. FIG. 10 is similar to FIG. 1, and FIG. 10 provides another implementation of the antenna 1. The antenna 10 includes a ground 11 and a radiating portion 102. The ground 11 is disposed on a surface of the dielectric substrate 111, and the radiating portion 102 includes at least one signal source 121 and a closed conductor loop 103. The closed conductor loop 103 has a first coupling conductor portion 1031 and a second coupling conductor portion 1032. The closed conductor loop 103 has a plurality of bending portions to form a three-dimensional structure, and the first coupling conductor portion 1031 and the second coupling conductor portion 1032 extend towards different directions to form the first coupling gap d1 between the first coupling conductor portion 1031 and the second coupling conductor portion 1032. Moreover, the closed conductor loop 103 further has a feeding portion 1033 and a short-circuit portion 1034 to form the second coupling gap d2 between the feeding portion 1033 and the short-circuit portion 1034. The feeding portion 1033 is electrically connected to the at least one signal source 121, and the short-circuit portion 1034 is electrically connected to the ground 11. In this way, the closed conductor loop 103 may approximately form an equivalent array antenna structure, which may effectively enhance an impedance bandwidth of an operating band. The radiating portion 102 makes the antenna 10 to generate the operating band (similar to the operating band 1211 of FIG. 1B). Moreover, a conductor section 1035 and a conductor section 1036 among components on a complete path of the closed conductor loop 103 are adjacent to each other, and a connection conductor section 1037 between the conductor section 1035 and the conductor section 1036 has an arc-shape path.

Descriptions of technical contents of FIG. 1B may be referred for a length of the ground 11, a width of the ground, a thickness of the dielectric substrate 111, a length of the total path of the closed conductor loop 103, a width of the closed conductor loop 103, a length of the first and the second coupling conductor portions 1031 and 1032, lengths of the first coupling gap d1, the second coupling gap d2 and the feeding portion 1033, and a length of the short-circuit portion 1034, and details thereof are not repeated herein.

Referring to FIG. 10, the radiating portion 102 makes the antenna 10 to generate the operating band. The operating band may be excited by a single resonance mode, a dual resonance mode or a multi resonance mode. The first coupling gap d1 is not more than 0.25 wavelength of the center frequency of the operating band. The second coupling gap d2 is not more than 0.1 wavelength of the center frequency of the operating band. A length of the total path of the closed conductor loop 103 is between 1.4 wavelengths and 4.2 wavelengths of the center frequency of the operating band. A length of the conductor path between the feeding portion 1033 and the short-circuit portion 1034 is between 0.7 wavelength and 2.1 wavelengths of the center frequency of the operating band.

The second coupling gap d2 makes the feeding portion 1033 and the short-circuit portion 1034 to form a mutual coupling structure. Thus, more uniformly excited current distribution may be formed, at a signal feeding terminal of the signal source 121, on the radiating portion 102. Therefore, it may reduce a variation degree of an antenna input impedance along with frequency within the operating band, and thus enhance impedance matching of the operating band. The first coupling gap d1 may increase orthogonality of a current vector on the path of the closed conductor loop 103 and a current vector of the signal feeding terminal of the radiating portion 102. Thus, it may effectively reduce coupling energy intensity besides the radiating portion 102. Therefore, other different type of antenna radiating portions may be configured besides the radiating portion 102. Moreover, within the operating band of the antenna 10, the radiating portion 102 may have relatively smaller mutual coupling effect with other adjacent antenna radiating portion. Thus, it may achieve good energy or ports isolations between the radiating portion 102 and the other adjacent antenna radiating portions, which may decrease overall size of the multi-antenna system. The aforementioned other types of antenna radiating portions may be an antenna radiating portion of PIFA types, IFA types, monopole antenna types, dipole antenna types, slot antenna types, loop antenna types, helix antenna types, QHA types, NHA types, other antenna types, or other combinations of antenna radiating portions of different antenna types. In some embodiments, there may be more than one ground. In some other embodiments, there may be more than one radiating portion.

Figure 11:
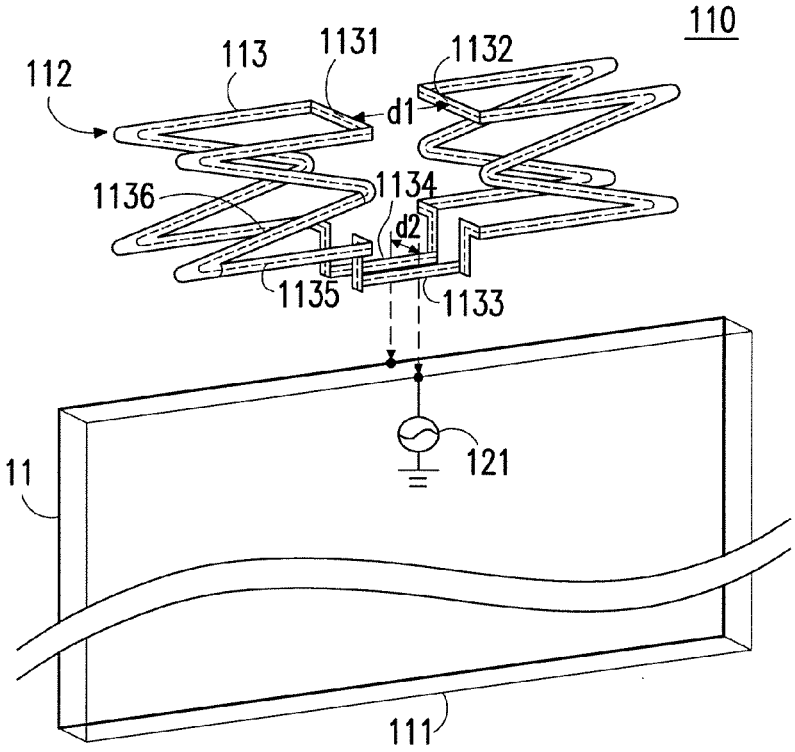
FIG. 11 is a structural schematic diagram of an antenna 110 according to an exemplary embodiment of the disclosure.

FIG. 11 is a structural schematic diagram of an antenna 110 according to an exemplary embodiment of the disclosure. FIG. 11 is similar to FIG. 1 and FIG. 2, and another implementation of the antennas 1 and 2 is provided. The antenna 110 includes a ground 11 and a radiating portion 112. The ground 11 is disposed on a surface of the dielectric substrate 111, and the radiating portion 112 includes at least one signal source 121 and a closed conductor loop 113. The closed conductor loop 113 has a first coupling conductor portion 1131 and a second coupling conductor portion 1132. The closed conductor loop 113 has a plurality of bending portions to form a three-dimensional structure, and the first coupling conductor portion 1131 and the second coupling conductor portion 1132 extend towards different directions to form the first coupling gap d1 between the first coupling conductor portion 1131 and the second coupling conductor portion 1132. Moreover, the closed conductor loop 113 further has a feeding portion 1133 and a short-circuit portion 1134 to form the second coupling gap d2 between the feeding portion 1133 and the short-circuit portion 1134. The feeding portion 1133 is electrically connected to the at least one signal source 121, and the short-circuit portion 1134 is electrically connected to the ground 11. In this way, the closed conductor loop 113 may approximately form an equivalent array antenna structure, which may effectively enhance an impedance bandwidth of an operating band. The radiating portion 112 makes the antenna 110 to generate the operating band (similar to the operating band 1211 of FIG. 1B). The operating band may be excited by the single resonance mode, the dual resonance mode or the multi resonance mode. Moreover, a conductor section 1135 and a conductor section 1136 among components on the complete path of the closed conductor loop 113 are adjacent to each other, and a connection angle between the conductor section 1135 and the conductor section 1136 may not be a right angle. In other implementations, the connection angle between the conductor section 1135 and the conductor section 1136 may include an acute angle and an obtuse angle.

Descriptions of technical contents of FIG. 1B may be referred for a length of the ground 11, a width of the ground, a thickness of the dielectric substrate 111, a length of the total path of the closed conductor loop 113, a width of the closed conductor loop 113, a length of the first and the second coupling conductor portions 1131 and 1132, lengths of the first coupling gap d1, the second coupling gap d2 and the feeding portion 1133, and a length of the short-circuit portion 1134, and details thereof are not repeated herein.

Referring to FIG. 11, the radiating portion 112 makes the antenna 110 to generate the operating band. The operating band may be excited by the single resonance mode, the dual resonance mode or the multi resonance mode. The first coupling gap d1 is not more than 0.25 wavelength of the center frequency of the operating band. The second coupling gap d2 is not more than 0.1 wavelength of the center frequency of the operating band. A length of the total path of the closed conductor loop 113 is between 1.4 wavelengths and 4.2 wavelengths of the center frequency of the operating band. A length of the conductor path between the feeding portion 1133 and the short-circuit portion 1134 is between 0.7 wavelength and 2.1 wavelengths of the center frequency of the operating band. The second coupling gap d2 makes the feeding portion 1133 and the short-circuit portion 1134 to form a mutual coupling structure. Thus, more uniformly excited current distribution could be generated, at a signal feeding terminal of the signal source 121, on the radiating portion 112. Therefore, it may reduce a variation degree of an antenna input impedance along with frequency within the operating band, and enhance impedance matching of the operating band.

The first coupling gap d1 may increase orthogonality of a current vector on the path of the closed conductor loop and a current vector of the signal feeding terminal of the radiating portion. Thus, it may effectively reduce near-field coupling energy intensity besides the radiating portion 112. Therefore, other different type of antenna radiating portions may be configured at the sides of the radiating portion 112. Moreover, within the operating band of the antenna 110, the radiating portion 112 may have relatively smaller mutual coupling effect with other adjacent antenna radiating portion. Thus, it may achieve good energy isolation between the radiating portion 112 and the other adjacent antenna radiating portion, which may decrease overall size of the multi-antenna system. The aforementioned other types of antenna radiating portions may be an antenna radiating portion of PIFA types, IFA types, monopole antenna types, dipole antenna types, slot antenna types, loop antenna types, helix antenna types, QHA types, NHA types, other antenna types, or other combinations of antenna radiating portions of different antenna types. In some embodiments, there may be more than one ground. In some other embodiments, there may be more than one radiating portion.

Figure 12:
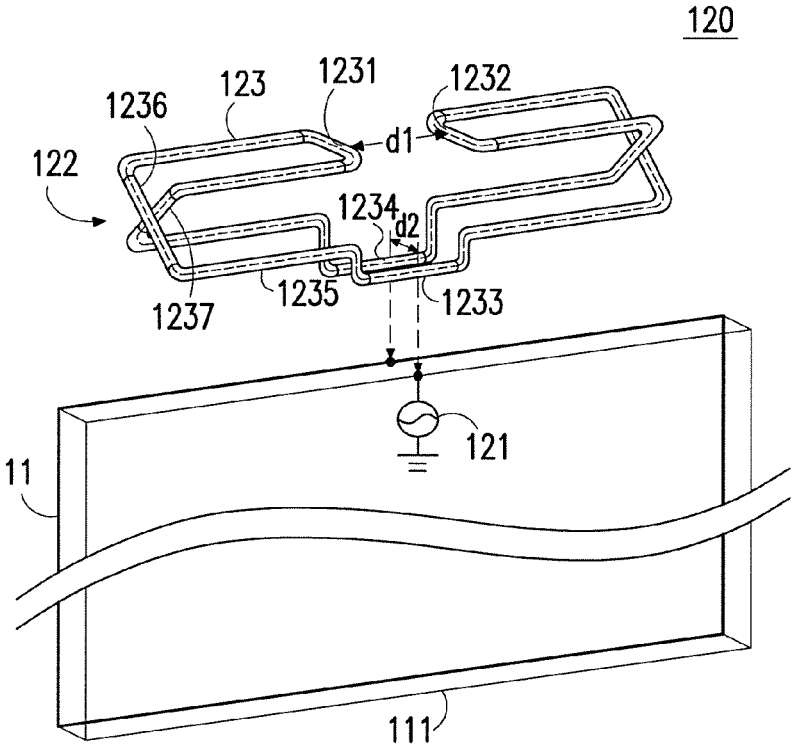
FIG. 12 is a structural schematic diagram of an antenna 120 according to an exemplary embodiment of the disclosure.

FIG. 12 is a structural schematic diagram of an antenna 120 according to an exemplary embodiment of the disclosure. FIG. 12 is similar to FIG. 1, and provides another implementation of the antennas 1. The antenna 120 includes a ground 11 and a radiating portion 122. The ground 11 is disposed on a surface of the dielectric substrate 111, and the radiating portion 122 includes at least one signal source 121 and a closed conductor loop 123. The closed conductor loop 123 may be implemented by a fine conductor film, a conductor thin wire, a solid or hollow thin conductor tube, though the disclosure is not limited thereto. The close conductor loop 123 has a first coupling conductor portion 1231 and a second coupling conductor portion 1232. The closed conductor loop 123 has a plurality of bending portions to form a three-dimensional structure, and the first coupling conductor portion 1231 and the second coupling conductor portion 1232 extend towards different directions to form the first coupling gap d1 between the first coupling conductor portion 1231 and the second coupling conductor portion 1232.

Moreover, the closed conductor loop 123 further has a feeding portion 1233 and a short-circuit portion 1234 to form the second coupling gap d2 between the feeding portion 1233 and the short-circuit portion 1234. The feeding portion 1233 is electrically connected to the at least one signal source 121, and the short-circuit portion 1234 is electrically connected to the ground 11. In this way, the closed conductor loop 123 may approximately form an equivalent array antenna structure, which may effectively enhance an impedance bandwidth of an operating band. The radiating portion 122 makes the antenna 120 to generate the operating band (similar to the operating band 1211 of FIG. 1B). The operating band may be excited by the single resonance mode, the dual resonance mode or the multi resonance mode. Moreover, a conductor section 1235 and a conductor section 1236 among components on the complete path of the closed conductor loop 123 are adjacent to each other, and the conductor section 1236 crosses over the adjacent conductor section 1237. Moreover, a connection angle between the conductor section 1135 and the conductor section 1136 may be a right angle, an acute angle or an obtuse angle.

Referring to FIG. 12, the radiating portion 122 makes the antenna 110 to generate the operating band. The operating band may be excited by the single resonance mode, the dual resonance mode or the multi resonance mode. The first coupling gap d1 is not more than 0.25 wavelength of the center frequency of the operating band. The second coupling gap d2 is not more than 0.1 wavelength of the center frequency of the operating band. A length of the total path of the closed conductor loop 123 is between 1.4 wavelengths and 4.2 wavelengths of the center frequency of the operating band. A length of the conductor path between the feeding portion 1233 and the short-circuit portion 1234 is between 0.7 wavelength and 2.1 wavelengths of the center frequency of the operating band. The second coupling gap d2 makes the feeding portion 1233 and the short-circuit portion 1234 to form a mutual coupling structure. Thus, more uniformly excited current distribution could be generated, at a signal feeding terminal of the signal source 121, on the radiating portion 122. Therefore, it may reduce a variation degree of an antenna input impedance along with frequency within the operating band, and enhance impedance matching of the operating band.

The first coupling gap d1 may increase orthogonality of a current vector on the path of the closed conductor loop and a current vector of the signal feeding terminal of the radiating portion. Thus, it may effectively reduce coupling energy intensity besides the radiating portion 122. Therefore, other different type of antenna radiating portions may be configured besides the radiating portion 122. Moreover, within the operating band of the antenna 120, the radiating portion 122 may have relatively smaller mutual coupling effect with other adjacent antenna radiating portion. Thus, it may achieve good energy isolation between the radiating portion 122 and the other adjacent antenna radiating portion, which may decrease overall size of the multi-antenna system. The aforementioned other types of antenna radiating portions may be an antenna radiating portion of PIFA types, IFA types, monopole antenna types, dipole antenna types, slot antenna types, loop antenna types, helix antenna types, QHA types, NHA types, other antenna types, or other combinations of antenna radiating portions of different antenna types. In some embodiments, there may be more than one ground. In some other embodiments, there may be more than one radiating portion.

Figure 13:
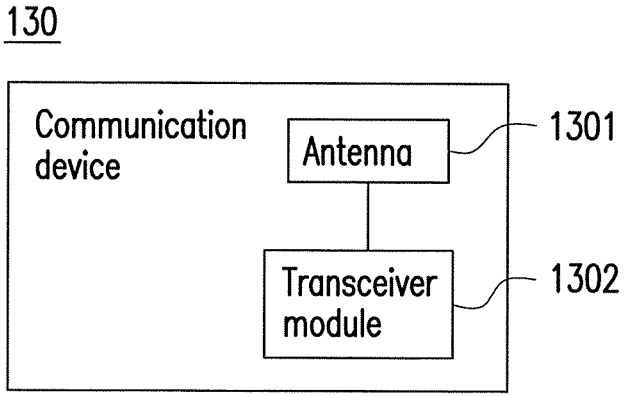
FIG. 13 is a functional block diagram of a communication device 130 according to an exemplary embodiment of the disclosure.

FIG. 13 is a functional block diagram of a communication device 130 according to an exemplary embodiment of the disclosure. The communication device 130 at least includes an antenna 1301 and a transceiver module 1302. The transceiver module 1302 includes at least one signal source, which is similar to the signal source 121 of FIG. 1A. The antenna 1301 is similar to the antenna 1 shown in FIG. 1A. The antenna 1301 is electrically connected or coupled to the transceiver module 1302 and includes at least one ground and at least one radiating portion.

FIG. 1A may be referred for detailed technical contents of the antenna 1301. The ground is disposed on a dielectric substrate, and the radiating portion includes a closed conductor loop. The closed conductor loop has a first coupling conductor portion and a second coupling conductor portion. The closed conductor loop has a plurality of bending portions to form a three-dimensional structure, and a first coupling gap is formed between the first and the second coupling conductor portions. The closed conductor loop further has a feeding portion and a short-circuit portion to form a second coupling gap between the feeding portion and the short-circuit portion. The feeding portion is electrically connected to the at least one signal source, and the short-circuit portion is electrically connected to the ground. Also, the radiating portion makes the antenna to generate an operating band, and the transceiver module 1302 is configured to transmit or receive electromagnetic signals of at least one communication band through the antenna 1301. The operating band may be excited by a single resonance mode, a dual resonance mode or a multi resonance mode.

In other implementations of the disclosure, the communication device 130 may include other devices (that are not illustrated in FIG. 13), for example, a filter, a frequency conversion unit, an amplifier, an analog-to-digital converter, a digital-to-analog converter, a modulator, a demodulator and a digital signal processor. The transceiver module 1302 may perform signal processing such as signal gain, filtering, frequency conversion or demodulation on the transmitted or received electromagnetic signals of the at least one communication band. However, technical emphasises of the present embodiment lie in the antenna 1301 and a coupling relation between the antenna 1301 and the transceiver module 1302, so that detailed descriptions of the other components of the communication device 130 are omitted herein.

Moreover, in all of the antenna embodiments of the disclosure, the closed conductor loop 13, 23, 33, 43, 103, 113 and 123 may be made of different conductor materials, for example, common conductive materials such as gold, silver, copper and iron, and so like, though implementations of the disclosure are not limited thereto. In other embodiments, the closed conductor loop 13, 23, 33, 43, 103, 113 and 123 may be any closed conductor loop, and the conductor material may include metal, alloy or non-metal conductor, for example, carbon nanotube, or other suitable conductor materials or combinations of different conductor materials, though the disclosure is not limited thereto. Moreover, a single material or a combination of different materials may be used to fabricate the closed conductor loop.

It will be apparent to those skilled in the art that various modifications and variations can be made to the structure of the disclosure without departing from the scope or spirit of the disclosure. In view of the foregoing, it is intended that the disclosure cover modifications and variations of this disclosure provided they fall within the scope of the following claims and their equivalents.

What is claimed is:

1. An antenna, comprising:

at least one ground; and at least one radiating portion, wherein the at least one ground is disposed on a dielectric substrate, and the at least one radiating portion comprises:

at least one signal source; and a closed conductor loop without a fracture, having a first coupling conductor portion and a second coupling conductor portion, and having a plurality of bending portions to form a three-dimensional structure, wherein a first coupling gap is formed between the first and the second coupling conductor portions, the closed conductor loop further has a feeding portion and a short-circuit portion to form a second coupling gap therebetween, the feeding portion is electrically connected or coupled to the at least one signal source, the short-circuit portion is electrically connected or coupled to the at least one ground, and the at least one radiating portion makes the antenna to generate an operating band, which is configured to transceive electromagnetic signals of at least one communication band, wherein one end of the feeding portion is connected to one end of the short-circuit portion via part of the bending portions and the first coupling conductor portion, and another end of the feeding portion is connected to another end of the short-circuit portion via part of the bending portions and the second coupling conductor portion, wherein the first coupling gap is not more than a 0.25 wavelength of a center frequency of the operating band and the second coupling gap is not more than a 0.1 wavelength of a center frequency of the operating band, wherein the first coupling gap is formed to increase an orthogonality of current vectors on a path of the closed conductor loop and current vectors of a signal feeding terminal of the radiating portion, and the second coupling gap makes the feeding portion and the short-circuit portion to form a mutual coupling structure.

2. The antenna of claim 1, wherein a total path length of the closed conductor loop is between 1.4 wavelengths and 4.2 wavelengths of a center frequency of the operating band.

3. The antenna of claim 1, wherein a length of a conductor path between the feeding portion and the short-circuit portion is between a 0.7 wavelength and 2.1 wavelengths of a center frequency of the operating band.

4. The antenna of claim 1, wherein a matching circuit is configured between the feeding portion and the at least one signal source.

5. The antenna of claim 4, wherein the matching circuit is a capacitive coupling feeding, an inductive coupling feeding, a low-pass, a high-pass, a band-pass, a band-reject, an L-type or a π-type circuit architecture.

6. The antenna of claim 1, wherein the at least one ground is formed on the dielectric substrate through printing or etching method.

7. The antenna of claim 1, wherein a path of the closed conductor loop has different conductor widths.

8. The antenna of claim 1, wherein a path of the closed conductor loop has an inductor or a capacitor of distributed or lumped types.

9. The antenna of claim 1, wherein other antenna radiating portions of different antenna types are capable of being configured besides the at least one radiating portion.

10. The antenna of claim 1, wherein antenna radiating portions of planar inverted-F antenna types, inverted-F antenna types, monopole antenna types, dipole antenna types, slot antenna types, loop antenna types, helix antenna types, quadrifilar helix antenna types, N-filar helix antenna types or other combinations of antenna radiating portions of different antenna types thereof are capable of being configured besides the at least one radiating portion.

11. A communication device, comprising:

at least one transceiver module, configured to be at least one signal source; and at least one antenna, electrically connected or coupled to the transceiver module, comprising at least one ground and at least one radiating portion, wherein the at least one ground is disposed on a dielectric substrate, and the at least one radiating portion comprises:

a closed conductor loop without a fracture, having a first coupling conductor portion and a second coupling conductor portion, and having a plurality of bending portions to form a three-dimensional structure, wherein a first coupling gap is formed between the first and the second coupling conductor portions, the closed conductor loop further has a feeding portion and a short-circuit portion to form a second coupling gap therebetween, the feeding portion is electrically connected or coupled to the at least one signal source, the short-circuit portion is electrically connected or coupled to the at least one ground, the at least one radiating portion makes the at least one antenna to generate an operating band, and the transceiver module is configured to transmit or receive electromagnetic signals of at least one communication band through the operating band generated by the at least one antenna, wherein one end of the feeding portion is connected to one end of the short-circuit portion via part of the bending portions and the first coupling conductor portion, and another end of the feeding portion is connected to another end of the short-circuit portion via part of the bending portions and the second coupling conductor portion, wherein the first coupling gap is not more than a 0.25 wavelength of a center frequency of the operating band and the second coupling gap is not more than a 0.1 wavelength of a center frequency of the operating band, wherein the first coupling gap is formed to increase an orthogonality of current vectors on a path of the closed conductor loop and current vectors of a signal feeding terminal of the radiating portion, and the second coupling gap makes the feeding portion and the short-circuit portion to form a mutual coupling structure.

12. The communication device of claim 11, wherein a total path length of the closed conductor loop is between 1.4 wavelengths and 4.2 wavelengths of a center frequency of the operating band.

13. The communication device of claim 11, wherein a length of a conductor path between the feeding portion and the short-circuit portion is between a 0.7 wavelength and 2.1 wavelengths of a center frequency of the operating band.

14. The communication device of claim 11, wherein a matching circuit is configured between the feeding portion and the at least one signal source.

15. The communication device of claim 14, wherein the matching circuit is a capacitive coupling feeding, an inductive coupling feeding, a low-pass, a high-pass, a band-pass, a band-reject, an L-type or a π-type circuit architecture.

16. The communication device of claim 11, wherein a path of the closed conductor loop has different conductor widths.

17. The communication device of claim 11, wherein other antenna radiating portions of different antenna types are capable of being configured besides the at least one radiating portion.

18. The communication device of claim 11, wherein antenna radiating portions of planar inverted-F antenna types, inverted-F antenna types, monopole antenna types, dipole antenna types, slot antenna types, loop antenna types, helix antenna types, quadrifilar helix antenna types, N-filar helix antenna types or other combinations of antenna radiating portions of different antenna types thereof are capable of being configured besides the at least one radiating portion.

19. The communication device of claim 11, wherein a path of the closed conductor loop has an inductor or a capacitor of distributed or lumped types.

* * * * *